US012727657B1

(12) United States Patent
McBee

(10) Patent No.: US 12,727,657 B1
(45) Date of Patent: Sep. 8, 2026

(54) CONFIGURABLE CUMMERBUND FOR A TACTICAL VEST

(71) Applicant: Ambitec Inc., Miami Beach, FL (US)

(72) Inventor: Shiloh Christopher McBee, Bozeman, MT (US)

(73) Assignee: Ambitec Inc., Miami Beach, FL (US)

( * ) Notice: Subject to any disclaimer, the term of this patent is extended or adjusted under 35 U.S.C. 154(b) by 0 days.

(21) Appl. No.: 19/411,860

(22) Filed: Dec. 8, 2025

(51) Int. Cl.
*A45F 5/02* (2006.01)

(52) U.S. Cl.
CPC ..... *A45F 5/02* (2013.01)

(58) Field of Classification Search
CPC ... A41D 13/0518; A41D 13/0568; A45F 3/00; A45F 5/02; F41H 1/02; A41F 9/002; A41F 9/025
See application file for complete search history.

(56) References Cited

U.S. PATENT DOCUMENTS

| | | | |
|---|---|---|---|
| 4,990,115 | A | 2/1991 | Vorhauer et al. |
| 5,363,863 | A | 11/1994 | Lelli et al. |
| 5,503,620 | A | 4/1996 | Danzger |
| 6,769,137 | B2 | 8/2004 | D'Annunzio |
| 8,002,159 | B2 | 8/2011 | Cragg |
| 8,142,377 | B2 | 3/2012 | Garth et al. |
| 8,353,065 | B1 | 1/2013 | Crye |
| 8,572,762 | B2 | 11/2013 | Herbener et al. |
| 9,055,773 | B2 | 6/2015 | Crye |
| 9,441,916 | B2 | 9/2016 | Seuk |
| 9,993,039 | B2 | 6/2018 | Nykoluk et al. |
| 10,051,948 | B2 | 8/2018 | Carver et al. |
| 10,314,355 | B1 | 6/2019 | Gallo |
| 11,041,696 | B2 | 6/2021 | Swan et al. |
| 11,079,203 | B2 | 8/2021 | Becker et al. |
| 11,805,832 | B2 * | 11/2023 | Boland ..... A41F 9/002 |
| 12,402,713 | B1 * | 9/2025 | Burnsed, Jr. ..... A45F 3/06 |

(Continued)

FOREIGN PATENT DOCUMENTS

| | | | |
|---|---|---|---|
| KR | 102393358 | B1 | 5/2022 |
| KR | 102406462 | B1 | 6/2022 |
| KR | 102530468 | B1 | 5/2023 |

OTHER PUBLICATIONS

"Tactical Molle Vest Quick Release Skeletal Mesh Cummerbund Strap Side Belt for JPC XPC NCPC CPC Vest," Aekvinks, retrieved from https://www.amazon.com/Tactical-Vest-Cummerbund-Side-Belt/dp/B09PNCCHZ4?th=1&psc=1 on Jul. 27, 2025.

(Continued)

*Primary Examiner* — Katherine M Moran
(74) *Attorney, Agent, or Firm* — Hartman & Citrin LLC

(57) ABSTRACT

A configurable cummerbund for a tactical vest can include a cummerbund front tip anchor located at the first end and having a first side and a second side; two or more webs attached to the cummerbund front tip anchor and extending along a length from the first end to the second end; a side panel attached to the webs; a cummerbund rear tip anchor located at the second end; and a cummerbund web slider located at the webs between the side panel and the cummerbund rear tip anchor. The webs can pass through and slidingly engage cummerbund web slider web channels of the cummerbund web slider, whereby the cummerbund web slider can be selectively located between the side panel and the rear tip anchor.

20 Claims, 14 Drawing Sheets

(56) References Cited

U.S. PATENT DOCUMENTS

| | | | | |
|---|---|---|---|---|
| 12,527,365 | B2 * | 1/2026 | Friedman | A41D 1/04 |
| 2013/0098961 | A1 | 4/2013 | Strum | |
| 2016/0202023 | A1 * | 7/2016 | Osman | A41F 15/002 2/2.5 |
| 2018/0184733 | A1 * | 7/2018 | LeMarbe | A41D 13/0518 |
| 2022/0079277 | A1 * | 3/2022 | Boland | A41F 9/025 |
| 2023/0036733 | A1 | 2/2023 | Hawkins et al. | |
| 2023/0128510 | A1 | 4/2023 | Kiester | |
| 2025/0072532 | A1 | 3/2025 | Friedman et al. | |
| 2025/0204616 | A1 * | 6/2025 | Friedman | A41D 1/04 |

OTHER PUBLICATIONS

"Modular Operator Plate Carrier Gen II," Condor Elite, Inc., retrieved from https://condoroutdoor.com/products/condor-modular-operator-plate-carrier?srsltid=AfmBOorjpcbpYQvo7G23T-zvOa0rbTWkI5LJNI_ufzaYOE8g0YoysL-D on Jul. 29, 2025.

"MSV Flex Cummerbund Kit (US Army)," Arbor Arms, retrieved from https://arborarmsusa.com/shop/cummerbund-kits/msv-flex-cummerbund-kit-us-army/?attribute_pa_attachment-type=2-taktic-buckles-3-strand&gad_source=1&gad_campaignid=22154955503&gclid=Cj0KCQjwnJfEBhCzARIsAIMtfKKAedzF7RTj6Jsl48v2DRUGjztxGJdJUNhXaAZISM_W1mYO_xeDvVUaAly5EALw_wcB on Jul. 28, 2025.

* cited by examiner

CONFIGURABLE CUMMERBUND FOR A TACTICAL VEST

TECHNICAL FIELD

The present disclosure relates generally to firearms and weapons technologies. More particularly, the present disclosure relates to a configurable cummerbund for a tactical vest, with the configurable cummerbund being capable of being incorporated into body armor and/or used for other applications.

BACKGROUND

Unless otherwise indicated herein, all disclosures in the background are not prior art to the claims in this application and are not admitted to be prior art by inclusion in this section.

Body armor, plate carriers, and/or other types of tactical vests (hereinafter referred to as "tactical vests") may be used for various purposes. For example, tactical vests may be used to protect wearers from sharp and fast-moving objects such as knives, bullets, shrapnel, and the like. Similarly, tactical vests may be worn by law enforcement, military, and/or civilian users to carry gear such as flashlights, navigation systems, communication systems, ammunition, explosives, maps, body armor plates, and the like. Thus, tactical vests have become popular in many markets and among a diverse group of users and/or consumers.

SUMMARY

The present disclosure is directed to a configurable cummerbund for a tactical vest. Embodiments of the configurable cummerbund for a tactical vest illustrated and described herein can include a cummerbund front tip anchor, which can be located at a first (e.g., front) end of the configurable cummerbund. The cummerbund front tip anchor can have two surfaces, with a cummerbund front tip anchor inner attachment surface located on an inside (e.g., configured for facing the body of a wearer) of the configurable cummerbund and a cummerbund front tip anchor outer attachment surface located on an outside (e.g., configured to face away from the body of a wearer) of the configurable cummerbund. One or more cummerbund webs (and preferably three cummerbund webs in some embodiments) can be attached to the cummerbund front tip anchor and extend along a length of the configurable cummerbund to a second (e.g., rear) end of the configurable cummerbund.

At the second (e.g., rear) end of the configurable cummerbund, the cummerbund web(s) can terminate at a cummerbund rear tip anchor. The cummerbund rear tip anchor can also have two surfaces, with a cummerbund rear tip anchor inner attachment surface located on an inside (e.g., configured for facing the body of a wearer) of the configurable cummerbund and a cummerbund rear tip anchor outer attachment surface located on an outside (e.g., configured to face away from the body of a wearer) of the configurable cummerbund. A cummerbund web slider can be disposed at the cummerbund webs, with the cummerbund webs being configured to slidingly engage (but not be connected to) the cummerbund web slider. The cummerbund web slider can also have two surfaces, with a cummerbund web slider inner attachment surface located on an inside (e.g., configured for facing the body of a wearer) of the configurable cummerbund and a cummerbund web slider outer attachment surface located on an outside (e.g., configured to face away from the body of a wearer) of the configurable cummerbund. The cummerbund web slider can be slid along the cummerbund webs between a side panel and the cummerbund rear tip anchor to adjust the effective length of the configurable cummerbund (and thereby the perceived or effective size of the tactical vest to which the configurable cummerbund is attached). Cummerbund rear tip anchors and cummerbund web sliders of two configurable cummerbunds can be partially and/or completely overlapped to adjust lengths of the cummerbund webs, in some instances. In some other instances, only the cummerbund rear tip anchors may be attached to the tactical vest and the cummerbund web sliders may be disengaged from attachment surfaces of the tactical vests for various reasons.

According to one aspect of the concepts and technologies disclosed herein, a configurable cummerbund for a tactical vest is disclosed. The configurable cummerbund can include a first end; a second end; a cummerbund front tip anchor located at the first end, the cummerbund front tip anchor including a cummerbund front tip anchor outer attachment surface located at a first side of the cummerbund front tip anchor and a cummerbund front tip anchor inner attachment surface located at a second side of the cummerbund front tip anchor; two or more webs attached to the cummerbund front tip anchor and extending along a length from the first end to the second end; and a side panel attached to the two or more webs. The side panel can include a first side that is configured to face away from a wearer and a second side that is configured to face toward the wearer. The configurable cummerbund can further include a cummerbund rear tip anchor located at the second end, the cummerbund rear tip anchor including a cummerbund rear tip anchor outer attachment surface located at a first side of the cummerbund rear tip anchor and a cummerbund rear tip anchor inner attachment surface located at a second side of the cummerbund rear tip anchor; and a cummerbund web slider located at the two or more webs between the side panel and the cummerbund rear tip anchor. The two or more webs can pass through and slidingly engage cummerbund web slider web channels, whereby the cummerbund web slider can be configured to be selectively located between the side panel and the cummerbund rear tip anchor.

In some embodiments, the cummerbund front tip anchor further can include a cummerbund front tip anchor pull tab that can be configured to be manipulated to disengage the cummerbund front tip anchor from an attachment surface of the tactical vest. In some embodiments, the cummerbund rear tip anchor inner attachment surface can include a hook material, and the cummerbund rear tip anchor outer attachment surface can include a loop material. In some embodiments, the cummerbund rear tip anchor inner attachment surface can include a further hook material that can be configured to engage a further loop material of a further cummerbund web slider of a further configurable cummerbund.

In some embodiments, the cummerbund front tip anchor inner attachment surface can include a hook material, and the cummerbund front tip anchor outer attachment surface can include a loop material. In some embodiments, the cummerbund rear tip anchor can be configured to overlap and engage a further cummerbund web slider of a further configurable cummerbund, and the cummerbund web slider can be configured to overlap and engage a further cummerbund rear tip anchor of the further configurable cummerbund.

In some embodiments, the cummerbund rear tip anchor outer attachment surface can include a loop material that can be configured to engage a hook material of a rear cummerbund attachment area cover of the tactical vest, and the cummerbund rear tip anchor outer attachment surface can include a further loop material that can be configured to engage the hook material of the rear cummerbund attachment area cover of the tactical vest. In some embodiments, the side panel can include a mounting surface located at the first side and a loop material located at the second side. The loop material can be configured to engage a hook material of an accessory or pouch.

According to another aspect of the concepts and technologies disclosed herein, a configurable cummerbund for a tactical vest is disclosed. The configurable cummerbund can include a first end; a second end; and a cummerbund front tip anchor located at the first end, the cummerbund front tip anchor including a cummerbund front tip anchor outer attachment surface located at a first side of the cummerbund front tip anchor and a cummerbund front tip anchor inner attachment surface located at a second side of the cummerbund front tip anchor. The cummerbund front tip anchor can be configured to engage a front cummerbund attachment area of the tactical vest. The configurable cummerbund can further include three webs attached to the cummerbund front tip anchor and extending along a length from the first end to the second end; and a side panel attached to the three webs. The side panel can include a first side that can be configured to face away from a wearer and a second side that can be configured to face toward the wearer. The configurable cummerbund can further include a cummerbund rear tip anchor located at the second end, the cummerbund rear tip anchor including a cummerbund rear tip anchor outer attachment surface located at a first side of the cummerbund rear tip anchor and a cummerbund rear tip anchor inner attachment surface located at a second side of the cummerbund rear tip anchor. The cummerbund rear tip anchor can be configured to engage a rear cummerbund attachment area of the tactical vest. The configurable cummerbund can further include a cummerbund web slider located at the three webs between the side panel and the cummerbund rear tip anchor. The three webs can pass through and slidingly engage three corresponding cummerbund web slider web channels, whereby the cummerbund web slider can be configured to be selectively located between the side panel and the cummerbund rear tip anchor.

In some embodiments, the cummerbund rear tip anchor inner attachment surface can include a hook material, and the cummerbund rear tip anchor outer attachment surface can include a loop material. In some embodiments, the cummerbund rear tip anchor inner attachment surface can include a further hook material that can be configured to engage a further loop material of a further cummerbund web slider of a further configurable cummerbund. In some embodiments, the cummerbund front tip anchor inner attachment surface can include a hook material, and the cummerbund front tip anchor outer attachment surface can include a loop material.

In some embodiments, the cummerbund rear tip anchor can be configured to overlap and engage a further cummerbund web slider of a further configurable cummerbund, and the cummerbund web slider can be configured to overlap and engage a further cummerbund rear tip anchor of the further configurable cummerbund. In some embodiments, the cummerbund rear tip anchor outer attachment surface can include a loop material that can be configured to engage a hook material of a rear cummerbund attachment area cover of the tactical vest, and the cummerbund rear tip anchor outer attachment surface can include a further loop material that can be configured to engage the hook material of the rear cummerbund attachment area cover of the tactical vest. In some embodiments, the side panel can include a mounting surface located at the first side, and a loop material located at the second side, wherein the loop material can be configured to engage a hook material of an accessory or pouch.

According to yet another aspect of the concepts and technologies disclosed herein, a configurable cummerbund for a tactical vest is disclosed. The configurable cummerbund can include a first end including a cummerbund front tip anchor pull tab; a second end including a cummerbund rear tip anchor pull tab; and a cummerbund front tip anchor located at the second end, the cummerbund front tip anchor including a cummerbund front tip anchor outer attachment surface located at a first side of the cummerbund front tip anchor and a cummerbund front tip anchor inner attachment surface located at a second side of the cummerbund front tip anchor. The cummerbund front tip anchor can be configured to engage a front cummerbund attachment area of the tactical vest. The configurable cummerbund further can include three webs attached to the cummerbund front tip anchor and extending along a length from the first end to the second end; and a side panel attached to the three webs. The side panel can include a first side that can be configured to face away from a wearer and a second side that can be configured to face toward the wearer. The configurable cummerbund further can include a cummerbund rear tip anchor located at the first end, the cummerbund rear tip anchor including a cummerbund rear tip anchor outer attachment surface located at a first side of the cummerbund rear tip anchor and a cummerbund rear tip anchor inner attachment surface located at a second side of the cummerbund rear tip anchor. The cummerbund rear tip anchor can be configured to engage a rear cummerbund attachment area of the tactical vest. The configurable cummerbund further can include a cummerbund web slider located at the three webs between the side panel and the cummerbund rear tip anchor. The three webs can pass through and slidingly engage three corresponding cummerbund web slider web channels, whereby the cummerbund web slider can be configured to be selectively located between the side panel and the cummerbund rear tip anchor.

In some embodiments, the cummerbund rear tip anchor inner attachment surface can include a hook material, the cummerbund rear tip anchor outer attachment surface can include a loop material, and the cummerbund rear tip anchor inner attachment surface can include a further hook material that can be configured to engage a further loop material of a further cummerbund web slider of a further configurable cummerbund. In some embodiments, the cummerbund front tip anchor inner attachment surface can include a hook material, and the cummerbund front tip anchor outer attachment surface can include a loop material.

In some embodiments, the cummerbund rear tip anchor can be configured to overlap and engage a further cummerbund web slider of a further configurable cummerbund, and the cummerbund web slider can be configured to overlap and engage a further cummerbund rear tip anchor of the further configurable cummerbund. In some embodiments, the cummerbund rear tip anchor outer attachment surface can include a loop material that can be configured to engage a hook material of a rear cummerbund attachment area cover of the tactical vest, and the cummerbund rear tip anchor outer attachment surface can include a further loop material that can be configured to engage the hook material of the rear cummerbund attachment area cover of the tactical vest.

Other systems, methods, devices, and/or structures according to various embodiments illustrated and described herein will be or become apparent to one with skill in the art upon review of the following drawings and detailed description. It is intended that all such additional systems, methods, devices, and/or structures be included within this description and be within the scope of this disclosure.

DETAILED DESCRIPTION

Figure 1:
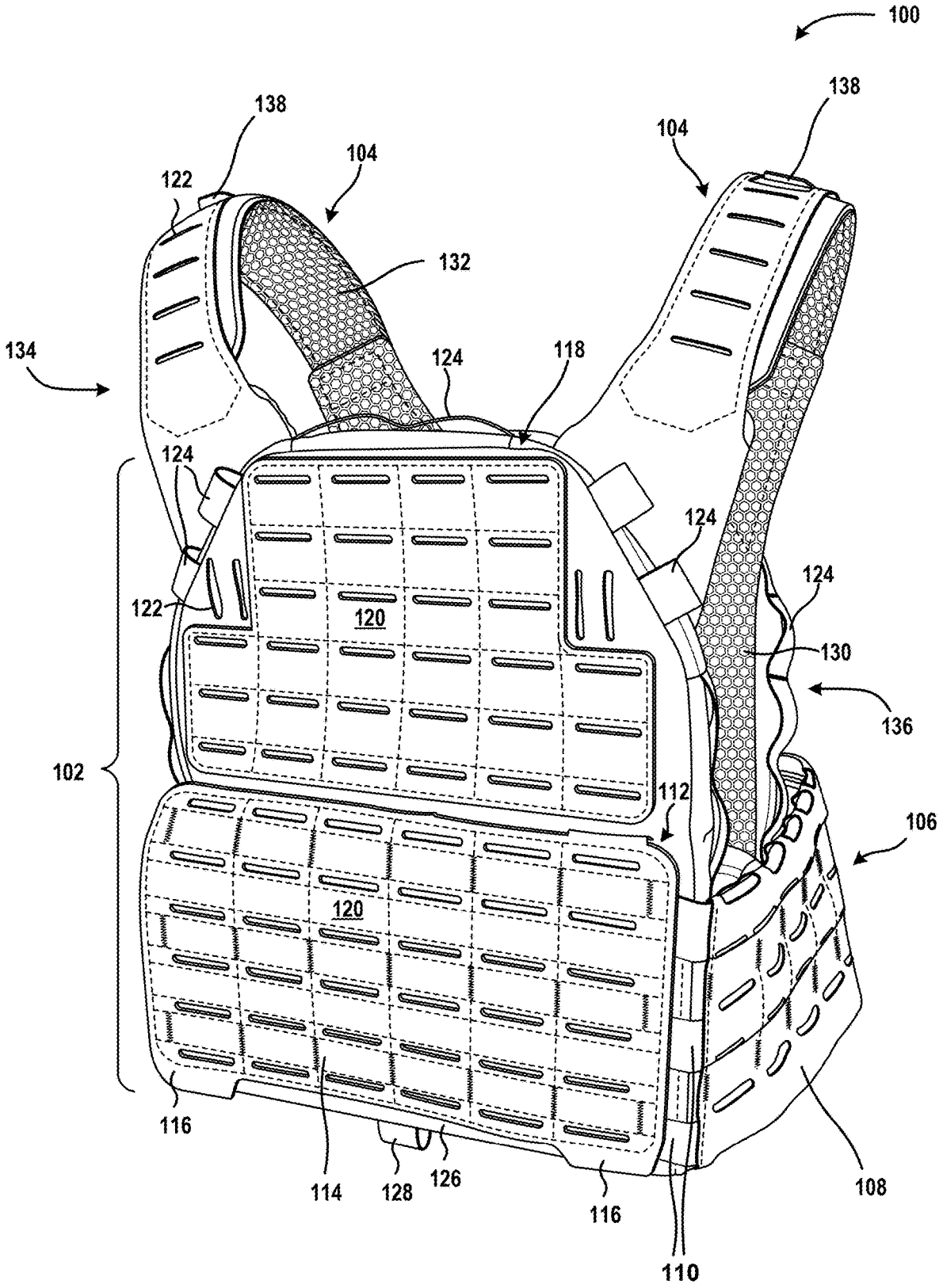
FIG. 1 is a line drawing illustrating a tactical vest including an embodiment of a configurable cummerbund for a tactical vest as viewed from a first side sometimes referred to herein as the front side, according to an illustrative embodiment of the concepts and technologies disclosed herein.

In the following detailed description, references are made to the accompanying drawings that form a part hereof and that show, by way of illustration, specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model, sample, or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of a configurable cummerbund for a tactical vest will be described.

Referring first to FIG. 1, various aspects of the concepts and technologies disclosed herein for a configurable cummerbund for a tactical vest will be illustrated and described in detail. In particular, FIG. 1 illustrates an example tactical vest 100, according to an example embodiment of the concepts and technologies disclosed herein. As used herein, a "tactical vest" can include a tactical vest, a bulletproof vest, a plate carrier, and/or other vests as is generally understood. As such, it should be understood that the illustrated embodiment of the tactical vest 100 is illustrative and should not be construed as being limiting in any way.

The tactical vest can include a body portion 102. The body portion 102 of the tactical vest 100 can have various shapes, dimensions, and/or configurations. In various embodiments of the concepts and technologies disclosed herein, and as illustrated in FIG. 1, the body portion 102 can include a structure of the tactical vest for covering a chest and/or stomach area of the wearer, protecting a chest and/or stomach area of the wearer, and/or various other reasons as illustrated and described herein and as known in the relevant arts. It should be understood that this example embodiment is illustrative, and therefore should not be construed as being limiting in any way.

The tactical vest 100 also can include one or more shoulder straps 104. The shoulder straps 104 can be formed in various configurations and/or can include various structures and/or features including, but not limited to, those shown in FIG. 1. Some features of the body portion 102 and the shoulder straps 104 are labeled in FIG. 1 and/or explained herein. Because the tactical vest 100 can include additional and/or alternative structures and/or features, it should be understood that these example embodiments are illustrative, and therefore should not be construed as being limiting in any way.

As shown in FIG. 1, the tactical vest 100 also can include a configurable cummerbund 106. In FIG. 1, a front side (e.g., a strike side) of the tactical vest 100 is illustrated and described. Thus, the view of the tactical vest 100 shown in FIG. 1 can correspond to a front view of the tactical vest 100. It should be understood that this example embodiment is illustrative, and therefore should not be construed as being limiting in any way. In some embodiments, including the embodiment illustrated in FIG. 1, the tactical vest 100 can include two configurable cummerbunds 106, for example, one configurable cummerbund 106 to wrap around a first side of the wearer (e.g., from a rear portion of the tactical vest 100 to a front portion of the tactical vest 100 along the first side of the wearer) and a second configurable cummerbund 106 to wrap around a second side of the wearer (e.g., from a rear portion of the tactical vest 100 to a front portion of the tactical vest 100 along the second side of the wearer). The various structures of the configuration cummerbund 106 are not visible in FIG. 1 but are illustrated and described herein in detail.

As visible in FIG. 1, the configurable cummerbund 106 can include a side panel 108. The side panel 108 can cover a side of the wearer, provide additional storage and/or attachment mechanisms, combinations thereof, or the like. The configurable cummerbund 106 also can include one or more cummerbund webs 110. In the illustrated embodiment, the configurable cummerbund 106 can include three cummerbund webs 110. It should be understood that this example embodiment is illustrative, and therefore should not be construed as being limiting in any way.

The cummerbund webs 110 can include two or more connection mechanisms, which are not visible in FIG. 1, but are visible in other FIGURES illustrated and described herein. According to various embodiments of the concepts and technologies disclosed herein, the cummerbund webs 110 can be configured to engage and/or be covered by one or more elements of a front cummerbund attachment area 112. The front cummerbund attachment area 112 can include a front cummerbund attachment area cover 114 in various embodiments. The front cummerbund attachment area cover 114 can be configured to cover various attachment mechanisms such as, for example, hook and loop fastener surfaces (e.g., a hook and loop fastener material belonging to the VELCRO® family of products, or the like), to which a front end of the configurable cummerbund 106 can attach in various embodiments. Additional aspects of the configurable cummerbund 106 are illustrated and described herein in detail.

In some embodiments, such as the embodiment shown in FIG. 1, the front cummerbund attachment area cover 114 can include one or more front cummerbund attachment area cover pull tabs 116. It can be appreciated that the front cummerbund attachment area cover pull tabs 116 can be omitted in some embodiments. At any rate, the front cummerbund attachment area cover pull tabs 116 can be pulled by a user, wearer, or other entity to pull the front cummerbund attachment area cover 114 away from the body portion 102 of the tactical vest 100, for example, to attach the configurable cummerbund 106 to the front cummerbund attachment area 112, to detach the configurable cummerbund 106 from the front cummerbund attachment area 112, and/or for other reasons. It should be understood that this example embodiment is illustrative, and therefore should not be construed as being limiting in any way.

As shown in FIG. 1, the tactical vest 100 also can include a front plate housing compartment 118. The front plate housing compartment 118 can extend, in some embodiments, from substantially the top of the body portion 102 to substantially the bottom of the body portion 102, though this is not necessarily the case in all embodiments. The front plate housing compartment 118 can be sized and/or configured to house, position, retain, and/or store an armor plate (not visible in FIG. 1). Because the size and/or configuration of armor plates can be standardized and/or non-standardized in various embodiments, it can be appreciated that the size, dimensions, and/or configurations of the front plate housing compartment 118 can vary according to various considerations. As such, it should be understood that the illustrated shape, size, configuration, and/or relative dimensions are illustrative and should not be construed as being limiting in any way.

As shown in FIG. 1, one or more portions of the front plate housing compartment 118 can include carrying and/or attachment mechanisms for various types of equipment such as, for example, modular lightweight load carrying equipment ("MOLLE") mounting pads (hereinafter "MOLLE mounting pads") 120. The MOLLE mounting pads 120 can be used to connect to and/or carry various types of equipment such as navigation systems, ammunition holders, magazine holders, optics, combinations thereof, or the like. Other portions of the tactical vest 100 such as, for example, the side panels 108 illustrated and described herein can also include MOLLE mounting pads 120, if desired. It should be understood that this example embodiment is illustrative, and therefore should not be construed as being limiting in any way.

As shown in FIG. 1, one or more portions of the tactical vest 100 can include various clip connection mechanisms (hereinafter referred to as "clip cuts") 122. As is generally known, clip cuts 122 can include laser cut webbing or other types of cuts in an outer surface of the tactical vest 100 to which clips, carabiners, or the like can be attached to hold, position, retain, and/or carry various types of equipment. In the illustrated embodiment, the shoulder straps 104, the front plate housing compartment 118, and/or the side panels 108 can include one or more clip cuts 122. It should be understood that the location, configuration, and/or dimensions of the clip cuts 122 are illustrative and therefore should not be construed as being limiting in any way. As shown in FIG. 1, one or more portions of the tactical vest 100 can include accessory loops 124. The accessory loops 124 can be provided to hold, retain, and/or carry various types of equipment. It should be understood that this example embodiment is illustrative, and therefore should not be construed as being limiting in any way.

In FIG. 1, a portion of a front plate retention sleeve panel 126 is illustrated. The front plate retention sleeve panel 126 can include a sheet of material that can be configured to wrap around and/or engage an armor plate that is inserted into the front plate housing compartment 118. It should be appreciated that in various embodiments, including the illustrated embodiment, the armor plate can be inserted into the front plate housing compartment 118 from the bottom of the tactical vest 100, and the front plate retention sleeve panel 126 can be wrapped around the bottom of the armor plate and then attached to various attachment mechanisms inside the front plate housing compartment 118 to secure the armor plate in position within the front plate housing compartment 118. The front plate housing compartment 118 can include a front plate housing compartment pull tab 128 to assist in disengaging the front plate retention sleeve panel 126 from the connection mechanisms within the front plate housing compartment 118 in various embodiments. It should be understood that this example embodiment is illustrative, and therefore should not be construed as being limiting in any way.

The tactical vest 100 also can include body padding and/or body pads (hereinafter referred to as "body pads") 130. The body pads 130 can be included to pad portions of the chest, stomach, and/or back of the wearer of the tactical vest 100. In some instances, a tactical vest 100 with armor plates and other equipment can weigh fifteen to forty pounds or even more. The body pads 130 can therefore be included in various embodiments for comfort, breathability, and/or other purposes. Similarly, the shoulder straps 104 can include shoulder pads 132, which can pad the should and/or portions of the back and/or chest of a wearer of the tactical vest 100. It should be understood that this example embodiment is illustrative, and therefore should not be construed as being limiting in any way.

Referring generally to the tactical vest 100 illustrated in FIG. 1, it can be appreciated that the tactical vest 100 can include a front side of the tactical vest 100 (hereinafter the "front side"), indicated generally by reference numeral 134. In FIG. 1, the front side 134 can correspond to a side of the tactical vest 100 that is facing the view plane in the view illustrated in FIG. 1 and therefore most visible in FIG. 1. Similarly, the tactical vest 100 can include a rear side of the tactical vest 100 (hereinafter the "rear side"), indicated generally by reference numeral 136. In FIG. 1, the rear side 136 can correspond to a side of the tactical vest 100 that is facing away from the view plane in the view illustrated in FIG. 1, and therefore is for the most part not visible in FIG. 1. It should be understood that this example embodiment is illustrative, and therefore should not be construed as being limiting in any way.

In FIG. 1, the shoulder straps 104 can be adjustable and/or configurable. In some embodiments, for example, the shoulder straps 104 can include shoulder strap adjustment pull tabs 138. The shoulder strap adjustment pull tabs 138 can be pulled to disengage one or more members of the shoulder straps 104 from one another, thereby enabling the configuration and/or adjustment of the shoulder straps 104 (e.g., to change the overall length of the shoulder straps 104, e.g., to shorten the overall length of the shoulder straps 104 by overlapping two more members of the shoulder straps 104 and/or to lengthen the overall length of the shoulder straps 104 by reducing overlap of the members of the shoulder straps 104). It should be understood that this example embodiment is illustrative, and therefore should not be construed as being limiting in any way.

Figure 2:
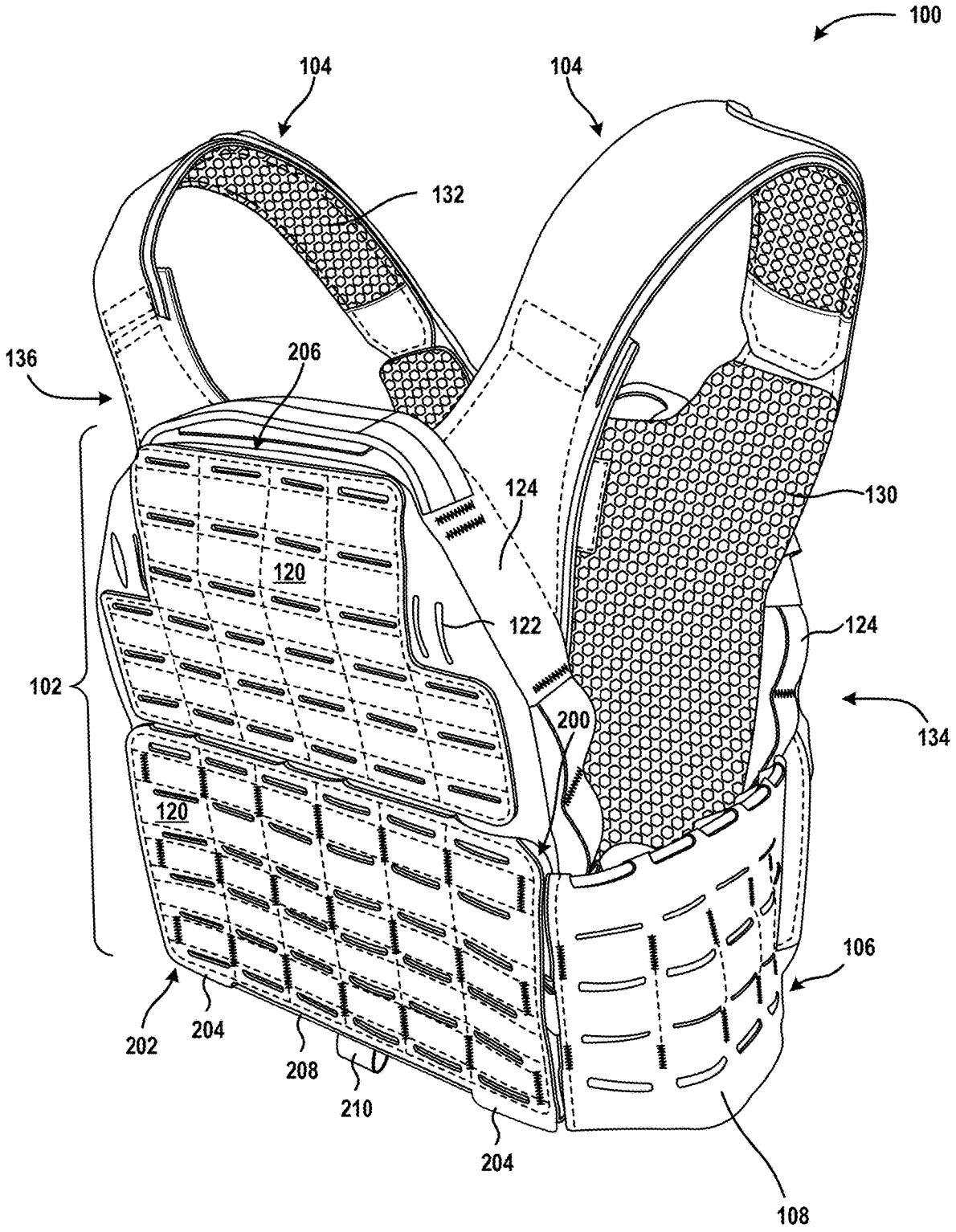
FIG. 2 is a line drawing illustrating a tactical vest including an embodiment of a configurable cummerbund for a tactical vest as viewed from a second side sometimes referred to herein as the back side, according to an illustrative embodiment of the concepts and technologies disclosed herein.

Turning now to FIG. 2, additional aspects of the concepts and technologies disclosed herein for a configurable cummerbund for a tactical vest 100 will be illustrated and described. In particular, FIG. 2 illustrates the rear side 136 of the tactical vest 100. It should be understood that this example embodiment is illustrative, and therefore should not be construed as being limiting in any way.

Many of the structures and/or features of the rear side 136 of the tactical vest 100 can be similar and/or even identical to the structures and/or features of the front side 134 of the tactical vest 100 illustrated and described above with reference to FIG. 1 and therefore are assigned the same reference numerals in FIG. 2. As shown in FIG. 2, the tactical vest 100 can include a rear cummerbund attachment area 200. The rear cummerbund attachment area 200 can include a rear cummerbund attachment area cover 202 in various embodiments. The rear cummerbund attachment area cover 202 can be configured to cover various attachment mechanisms such as, for example, hook and loop fastener surfaces (e.g., a hook and loop fastener material belonging to the VELCRO® family of products, or the like), to which a rear end of the configurable cummerbund 106 can attach in various embodiments. It should be understood that this example embodiment is illustrative, and therefore should not be construed as being limiting in any way.

In some embodiments, such as the embodiment shown in FIG. 2, the rear cummerbund attachment area cover 202 can include one or more rear cummerbund attachment area cover pull tabs 204. It can be appreciated that the rear cummerbund attachment area cover pull tabs 204 can be omitted in some embodiments. At any rate, the rear cummerbund attachment area cover pull tabs 204 can be pulled by a user, wearer, or other entity to pull the rear cummerbund attachment area cover 202 away from the body portion 102 of the tactical vest 100, for example, to attach the configurable cummerbund 106 to the rear cummerbund attachment area 200, to detach the configurable cummerbund 106 from the rear cummerbund attachment area 200, and/or for other reasons. It should be understood that this example embodiment is illustrative, and therefore should not be construed as being limiting in any way.

As shown in FIG. 2, the tactical vest 100 also can include a rear plate housing compartment 206. The rear plate housing compartment 206 can extend, in some embodiments, from substantially the top of the body portion 102 to substantially the bottom of the body portion 102, though this is not necessarily the case in all embodiments. The rear plate housing compartment 206 can be sized and/or configured to house, position, retain, and/or store an armor plate (not visible in FIG. 2). Because the size and/or configuration of armor plates can be standardized and/or non-standardized in various embodiments, it can be appreciated that the size, dimensions, and/or configurations of the rear plate housing compartment 206 can vary according to various considerations. As such, it should be understood that the illustrated shape, size, configuration, and/or relative dimensions are illustrative and should not be construed as being limiting in any way.

As shown in FIG. 2, one or more portions of the rear plate housing compartment 206 can include carrying and/or attachment mechanisms for various types of equipment such as, for example, MOLLE mounting pads 120, clip cuts 122, accessory loops 124, and the like for holding, positioning, retaining, and/or carrying various types of equipment, as illustrated and described above with reference to FIG. 1. It should be understood that this example embodiment is illustrative, and therefore should not be construed as being limiting in any way.

In FIG. 2, a portion of a rear plate retention sleeve panel 208 is illustrated. The rear plate retention sleeve panel 208 can include a sheet of material that can be configured to wrap around and/or engage an armor plate that is inserted into the rear plate housing compartment 206. It should be appreciated that in various embodiments, including the illustrated embodiment, the armor plate can be inserted into the rear plate housing compartment 206 from the bottom of the tactical vest 100, and the rear plate retention sleeve panel 208 can be wrapped around the bottom of the armor plate and then attached to various attachment mechanisms inside the rear plate housing compartment 206 to secure the armor plate in position within the rear plate housing compartment 206. The rear plate housing compartment 206 can include a rear plate housing compartment pull tab 210 to assist in disengaging the rear plate retention sleeve panel 208 from the connection mechanisms within the rear plate housing compartment 206 in various embodiments. It should be understood that this example embodiment is illustrative, and therefore should not be construed as being limiting in any way.

It can be appreciated that the rear side 136 of the tactical vest 100 can correspond to a side of the tactical vest 100 that is facing the view plane in the view illustrated in FIG. 2 and therefore most visible in FIG. 2. Similarly, the tactical vest 100 can include a rear side of the tactical vest 100 (hereinafter the "rear side"), indicated generally by reference numeral 136. In FIG. 2, the front side 134 can correspond to a side of the tactical vest 100 that is facing away from the view plane in the view illustrated in FIG. 2, and therefore is for the most part not visible in FIG. 2. It should be understood that this example embodiment is illustrative, and therefore should not be construed as being limiting in any way.

Figure 3:
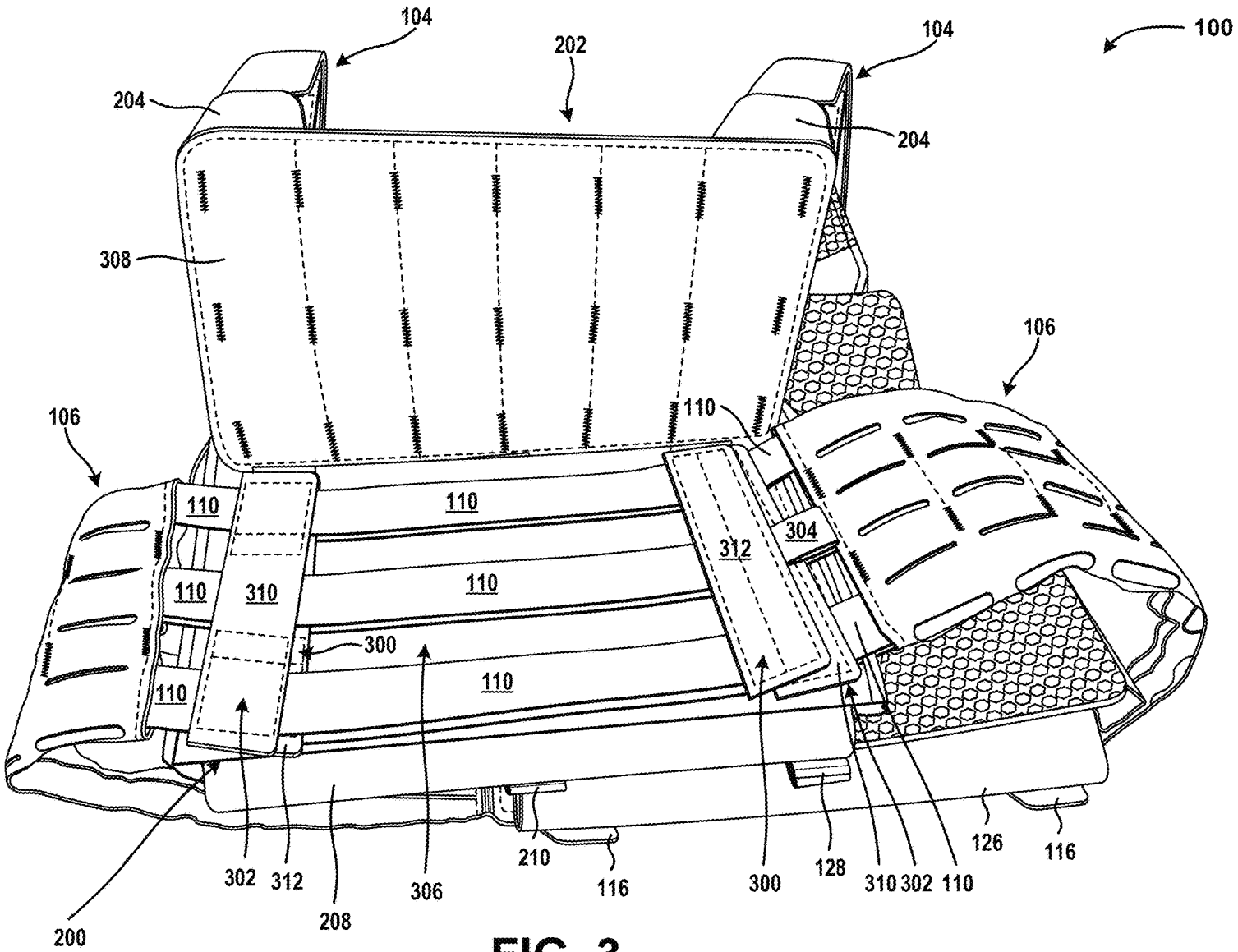
FIG. 3 is a line drawing illustrating a configurable cummerbund for a tactical vest as viewed from a first side sometimes referred to herein as the front side, according to an illustrative embodiment of the concepts and technologies disclosed herein.

Turning now to FIG. 3, additional aspects of the concepts and technologies disclosed herein for a configurable cummerbund for a tactical vest 100 will be illustrated and described. In particular, FIG. 3 illustrates a perspective view of the rear side 136 of the tactical vest 100, with two of the configurable cummerbunds 106 visible overlapping and attaching to one another, and one of the configurable cummerbunds 106 engaging the rear cummerbund attachment area 200. It should be understood that this example embodiment is illustrative, and therefore should not be construed as being limiting in any way.

As can be seen in FIG. 3, embodiments of the concepts and technologies disclosed herein can enable the configurable cummerbunds 106 to overlap and attached to one another, as well as to the tactical vest 100. Each of the configurable cummerbunds 106 can include a cummerbund rear tip anchor 300, which can include a stationary attachment structure at the end of the configurable cummerbund 106. Additionally, each of the configurable cummerbunds 106 can include a cummerbund web slider 302, which can include a sliding attachment structure through which the cummerbund webs 110 of the configurable cummerbund 106 pass, thereby providing an adjustable attachment mechanism at the end of the configurable cummerbund 106. The adjustments enabled by and the functions of the cummerbund rear tip anchor 300 and the cummerbund web slider 302 will be illustrated and described in more detail herein. As shown in FIG. 3, the cummerbund rear tip anchor 300 of the configurable cummerbund 106 also can include a cummerbund rear tip anchor pull tab 304, which can be used to disengage the cummerbund rear tip anchor 300 from the rear cummerbund attachment area 200, which will be illustrated and described in more detail herein as well.

As shown in FIG. 3, a configurable cummerbund 106 on the right side of FIG. 3 is engaging and connected to the rear cummerbund attachment area 200 of the tactical vest 100. Specifically, the configurable cummerbund 106 on the right side of FIG. 3 is engaging a cummerbund rear attachment area attachment surface 306 of the rear cummerbund attachment area 200, the cummerbund rear attachment area attachment surface 306 corresponding, in some embodiments, to hook and loop material that covers a portion or all of the rear cummerbund attachment area 200. In particular, a cummerbund rear tip anchor 300 of the configurable cummerbund 106 that is shown as wrapping around the right side of the tactical vest 100 can engage a portion of the left side of an exposed cummerbund rear attachment area attachment surface 306 of the rear cummerbund attachment area 200. In various embodiments, including the embodiment shown in FIG. 3, an inner surface of the cummerbund rear tip anchor 300 (which will be referred to herein as the "cummerbund rear tip anchor inner attachment surface") can engage the rear cummerbund attachment area 200, specifically the cummerbund rear attachment area attachment surface 306, which can be exposed by a user or other entity by opening the rear cummerbund attachment area cover 202 (e.g., by pulling one or more of the rear cummerbund attachment area cover pull tabs 204). An inner surface of the rear cummerbund attachment area cover 202 can include a rear cummerbund attachment area cover attachment surface 308, which can include a hook and loop material or other attachment mechanisms. In the illustrated embodiment shown in FIG. 3, the rear cummerbund attachment area cover attachment surface 308 can include a hook material and the cummerbund rear attachment area attachment surface 306 can include a loop material. It should be understood that this example embodiment is illustrative, and therefore should not be construed as being limiting in any way. The cummerbund rear tip anchor inner attachment surface is not visible in FIG. 3, but will be illustrated and described herein below, at least with reference to FIGS. 4 and 6.

Additionally, as shown in FIG. 3, a cummerbund web slider 302 of the configurable cummerbund 106 that is shown as wrapping around the right side of the tactical vest 100 can engage a portion of the right side of an exposed cummerbund rear attachment area attachment surface 306 of the rear cummerbund attachment area 200. In various embodiments, including the embodiment shown in FIG. 3, an inner surface of the cummerbund web slider 302 (which will be referred to herein as the "cummerbund web slider inner attachment surface") can engage the rear cummerbund attachment area 200, specifically the cummerbund rear attachment area attachment surface 306, which can be exposed by a user or other entity by opening the rear cummerbund attachment area cover 202 (e.g., by pulling one or more of the rear cummerbund attachment area cover pull tabs 204). It should be understood that this example embodiment is illustrative, and therefore should not be construed as being limiting in any way. The cummerbund web slider inner attachment surface is not visible in FIG. 3, but will be illustrated and described herein below, at least with reference to FIGS. 4 and 6.

As can be seen in FIG. 3, the configurable cummerbund 106 that wraps around the right side of the tactical vest 100 illustrated in FIG. 3 can be overlapped and/or engaged by the configurable cummerbund 106 that wraps around the left side of the tactical vest 100 illustrated in FIG. 3. In particular, in the illustrated configuration, the cummerbund web slider 302 of each of the configurable cummerbunds 106 can include an outer surface of the cummerbund web slider 302, which is visible in FIG. 3 and is referred to herein as the "cummerbund web slider outer attachment surface 310." Similarly, the cummerbund rear tip anchor 300 of each of the configurable cummerbunds 106 can include an outer surface of the cummerbund rear tip anchor 300, which is visible in FIG. 3 and is referred to herein as the "cummerbund rear tip anchor outer attachment surface 312." As shown in FIG. 3, the cummerbund rear tip anchor inner attachment surface of the cummerbund rear tip anchor 300 of the configurable cummerbund 106 that wraps around the left side of the tactical vest 100 shown in FIG. 3 can include a loop material and can engage a hook material of the cummerbund web slider outer attachment surface 310 of the configurable cummerbund 106 that wraps around the right side of the tactical vest 100 shown in FIG. 3. Because the hook and loop materials can be interchanged and/or swapped as desired, it should be understood that this example embodiment is illustrative, and therefore should not be construed as being limiting in any way.

Similarly, as shown in FIG. 3, the cummerbund web slider inner attachment surface of the cummerbund web slider 302 of the configurable cummerbund 106 that wraps around the left side of the tactical vest 100 shown in FIG. 3 can include a loop material and can engage a hook material of the cummerbund web slider outer attachment surface 310 of the configurable cummerbund 106 that wraps around the right side of the tactical vest 100 shown in FIG. 3. Because the hook and loop materials can be interchanged and/or swapped as desired, it should be understood that this example embodiment is illustrative, and therefore should not be construed as being limiting in any way.

It can be appreciated with reference to FIGS. 2-3 that if the rear cummerbund attachment area cover 202 shown in FIG. 3 is returned to its position over the configurable cummerbunds 106 and the rear cummerbund attachment area 200, that the rear cummerbund attachment area cover 202 may engage the cummerbund rear tip anchor outer attachment surface 312 and the cummerbund web slider outer attachment surface 310 of the configurable cummerbund 106 that wraps around the left side of the tactical vest 100 shown in FIG. 3 (and therefore will be configured in a manner that may be similar to the tactical vest 100 shown in FIG. 2). It should be understood that this example embodiment is illustrative, and therefore should not be construed as being limiting in any way.

Figure 4:
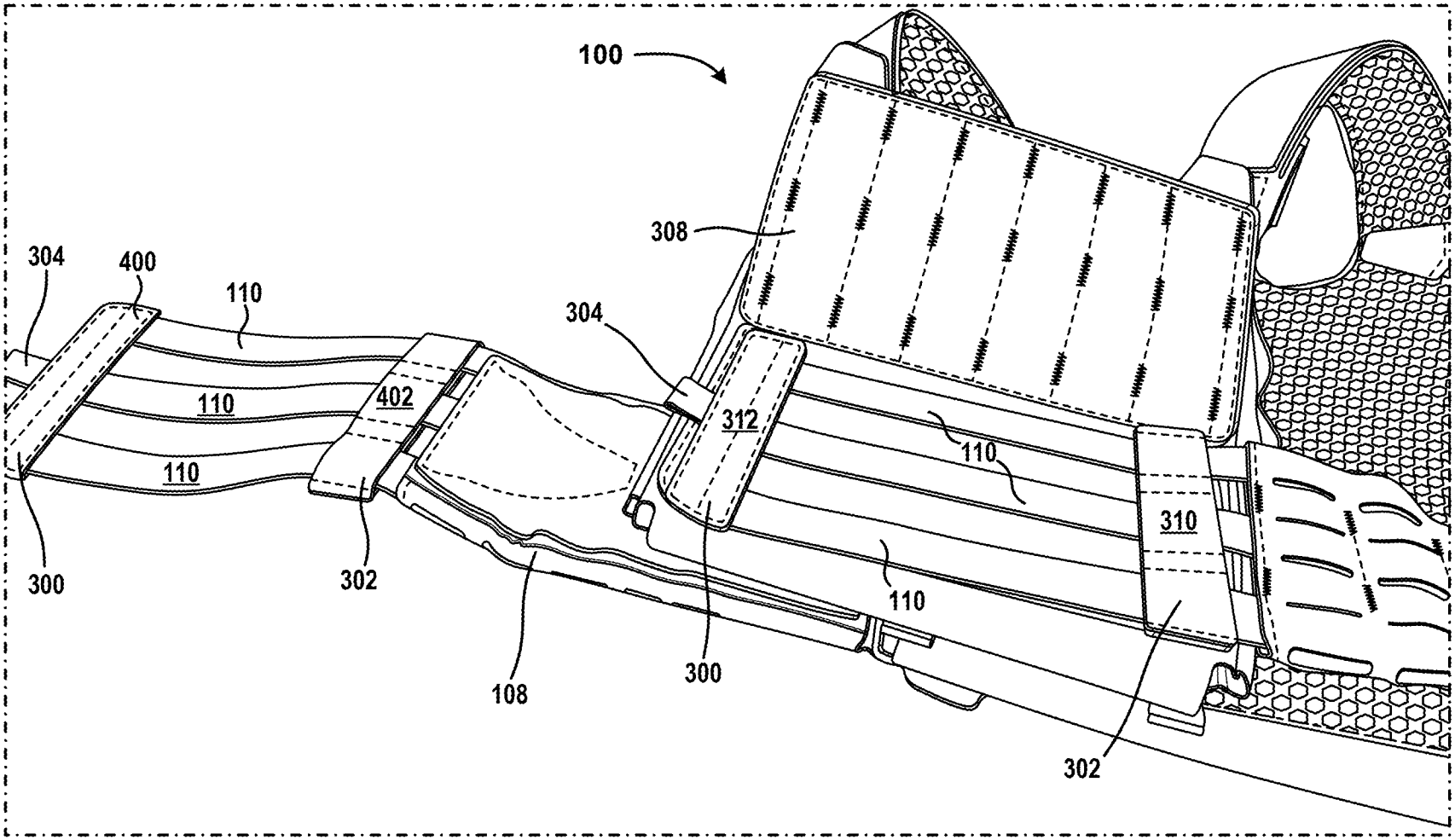
FIG. 4 is a line drawing illustrating a configurable cummerbund for a tactical vest as viewed from a second side sometimes referred to herein as the back side, according to an illustrative embodiment of the concepts and technologies disclosed herein.

Turning now to FIG. 4, additional aspects of the configurable cummerbund 106 illustrated and described herein are shown. In particular, FIG. 4 illustrates the tactical vest 100 shown in FIG. 3. In FIG. 4, however, a user or other entity has pulled the cummerbund rear tip anchor pull tab 304 of the configurable cummerbund 106 that was illustrated in FIG. 3 as wrapping around the left side of tactical vest 100, thereby disengaging the configurable cummerbund 106 from its engagement and/or attachment to the configurable cummerbund 106 that wraps around the right side of the tactical vest 100 shown in FIGS. 3-4. It should be understood that this example embodiment is illustrative, and therefore should not be construed as being limiting in any way.

In FIG. 4, the cummerbund rear tip anchor inner attachment surface 400 of the cummerbund rear tip anchor 300 of the opened configurable cummerbund 106 is visible and is labeled. Similarly, the cummerbund web slider inner attachment surface 402 of the cummerbund web slider 302 of the opened configurable cummerbund 106 is visible and is labeled in FIG. 4. Additional aspects of these and other components of the configurable cummerbund 106 are illustrated and described herein in more detail.

Figure 5:
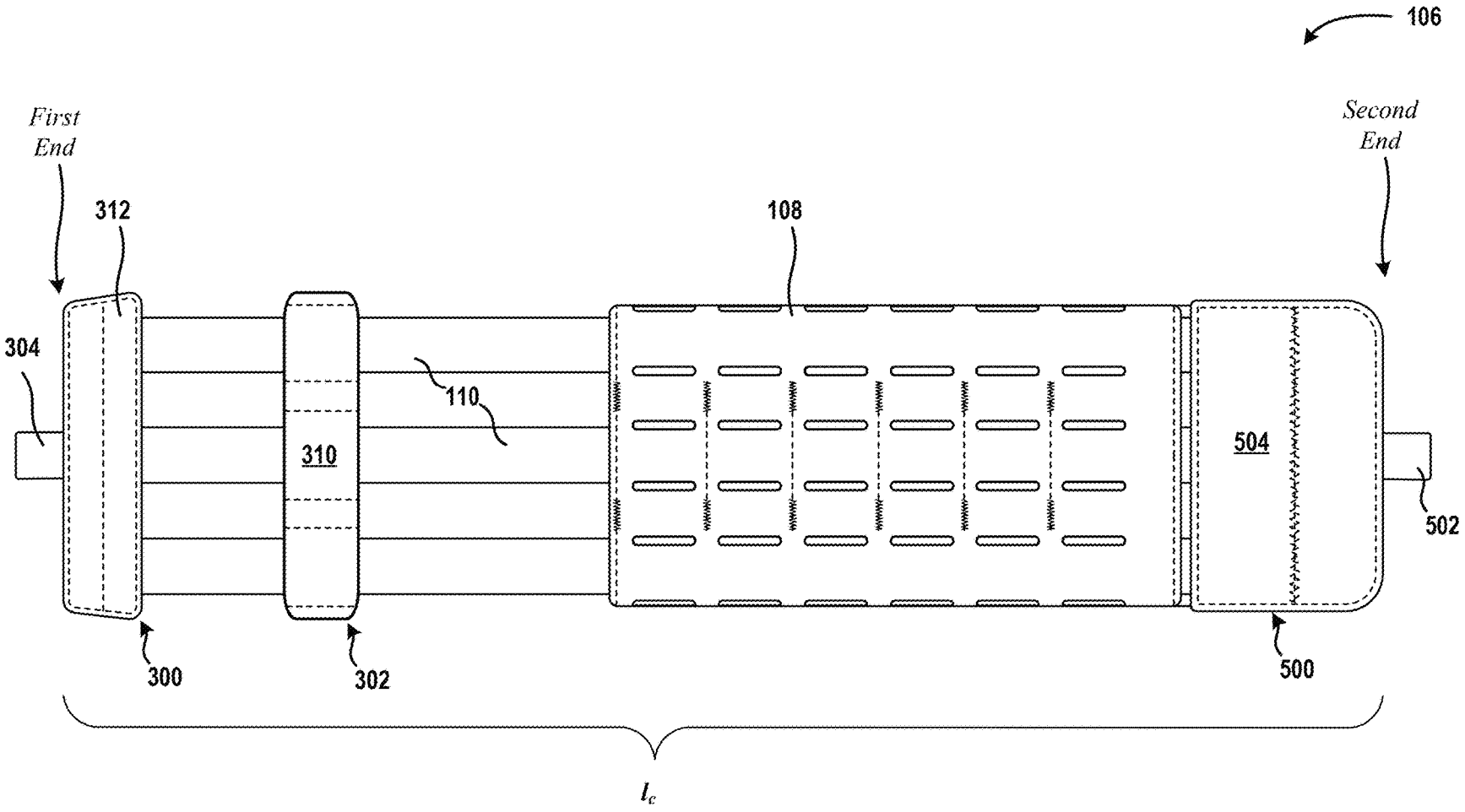
FIG. 5 is a line drawing illustrating an example configurable cummerbund for a tactical vest as viewed from a first side sometimes referred to herein as the front side that faces away from the wearer, according to an illustrative embodiment of the concepts and technologies disclosed herein.

Turning now to FIG. 5, additional aspects of the configurable cummerbund 106 will be described in detail. In particular, FIG. 5 illustrates an outer surface (e.g., a surface of the configurable cummerbund 106 that faces away from the wearer) according to an illustrative embodiment. It can be appreciated that the size, configuration, shape, and relative dimensions of the components of the configurable cummerbund 106 shown in FIG. 5 are illustrative. As such, the illustrated embodiment is illustrative and the specific embodiment shown in FIG. 5 should not be construed as being limiting in any way.

As shown in FIG. 5, the configurable cummerbund 106 can include the cummerbund rear tip anchor 300, which can have attached thereto a cummerbund rear tip anchor pull tab 304. The configurable cummerbund 106 can include one or more cummerbund webs 110. In the illustrated embodiment, the configurable cummerbund 106 can include three cummerbund webs 110. It should be understood that this can be a standard number of cummerbund webs 110 in some embodiments, but that other numbers of cummerbund webs 110 are possible and are contemplated. It can be appreciated that the cummerbund webs 110 can pass through the cummerbund web slider 302, as explained herein. In various embodiments, as is illustrated and described in more detail herein, the cummerbund webs 110 may not be attached to the cummerbund web slider 302 in various embodiments, and the cummerbund web slider 302 therefore can slide along the cummerbund webs 110 for various purposes as illustrated and described herein. It should be understood that this example embodiment is illustrative, and therefore should not be construed as being limiting in any way.

The cummerbund webs 110 also can pass through a side panel 108. In some embodiments, the side panel 108 can be attached to the cummerbund webs 110 to immobilize the side panel 108 relative to the cummerbund webs 110 (e.g., to prevent sliding of the side panel 108 relative to the cummerbund webs 110). The cummerbund webs 110 can continue through the side panel 108 and can be configured to terminate at a cummerbund front tip anchor 500. The cummerbund front tip anchor 500 can be configured to attach to the front cummerbund attachment area 112 of the tactical vest 100, for example to secure the configurable cummerbund 106 to the tactical vest 100. With additional reference to FIG. 6, it can be appreciated that a cummerbund front tip anchor inner attachment surface (not visible in FIGS. 5-6, but illustrated and described herein, particularly with reference to FIG. 7) of the cummerbund front tip anchor 500 can attach to a front cummerbund attachment area attachment surface 600 of the tactical vest 100 in some embodiments. It should be understood that this example embodiment is illustrative, and therefore should not be construed as being limiting in any way.

Figure 6:
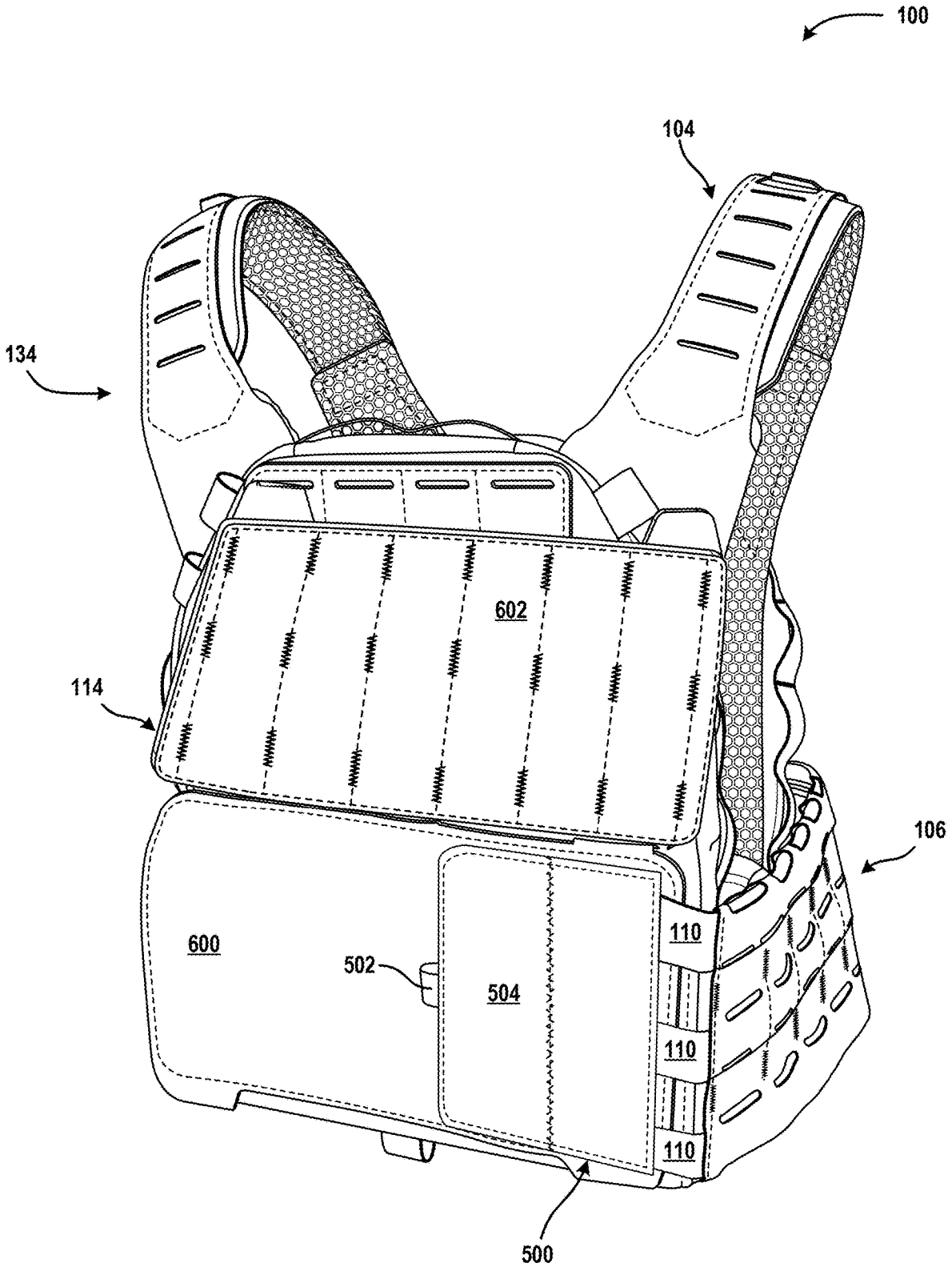
FIG. 6 is a line drawing illustrating a tactical vest including an embodiment of a configurable cummerbund for a tactical vest as viewed from a first side sometimes referred to herein as the front side, according to an illustrative embodiment of the concepts and technologies disclosed herein.

As can be seen in FIGS. 5 and 6, the cummerbund front tip anchor 500 of the configurable cummerbund 106 can include a cummerbund front tip anchor pull tab 502. In some embodiments, the cummerbund front tip anchor pull tab 502 can be pulled or otherwise manipulated, for example by a user, wearer, or other entity, to disengage the cummerbund front tip anchor inner attachment surface from the front cummerbund attachment area attachment surface 600 and away from the body portion 102 of the tactical vest 100, for example. It should be understood that this example embodiment is illustrative, and therefore should not be construed as being limiting in any way.

In some embodiments, the front cummerbund attachment area attachment surface 600 can include a loop material and the cummerbund front tip anchor inner attachment surface can include a hook material. Additionally, it can be appreciated that the cummerbund front tip anchor 500 can include a cummerbund front tip anchor outer attachment surface 504. In various embodiments, including the embodiment illustrated in FIG. 6, the cummerbund front tip anchor outer attachment surface 504 can include a loop material, and the front cummerbund attachment area cover 114 can include a front cummerbund attachment area cover inner attachment surface 602, which can include a hook material in some embodiments.

It can be appreciated with reference to FIGS. 1 and 6 that if the front cummerbund attachment area cover 114 shown in FIG. 6 is returned to its position over the configurable cummerbund 106 and the front cummerbund attachment area attachment surface 600, that the front cummerbund attachment area cover inner attachment surface 602 of the front cummerbund attachment area cover 114 may engage the cummerbund front tip anchor outer attachment surface 504 of the configurable cummerbund 106, and the cummerbund front tip anchor inner attachment surface of the configurable cummerbund 106 can engage the front cummerbund attachment area attachment surface 600. It should be understood that this example embodiment is illustrative, and therefore should not be construed as being limiting in any way.

As shown in FIG. 5, the configurable cummerbund 106 can include a first end, which can correspond to an end of the configurable cummerbund 106 that is configured to attach to the rear side 136 of the tactical vest. The configurable cummerbund 106 also can include a second end, which can correspond to an end of the configurable cummerbund 106 that is configured to attach to the front side 134 of the tactical vest. As shown in FIG. 5, the configurable cummerbund 106 also can have a cummerbund length $l_c$, which can correspond to an overall length for the configurable cummerbund 106. The cummerbund length $l_c$ may or may not include the cummerbund front tip anchor pull tab 502 and/or the cummerbund rear tip anchor pull tab 304 in various embodiments (in the example shown in FIG. 5, the cummerbund front tip anchor pull tab 502 and the cummerbund rear tip anchor pull tab 304 are not included in the cummerbund length $l_c$. It should be understood that this illustrated embodiment is illustrative and should not be construed as being limiting in any way.

Figure 7:
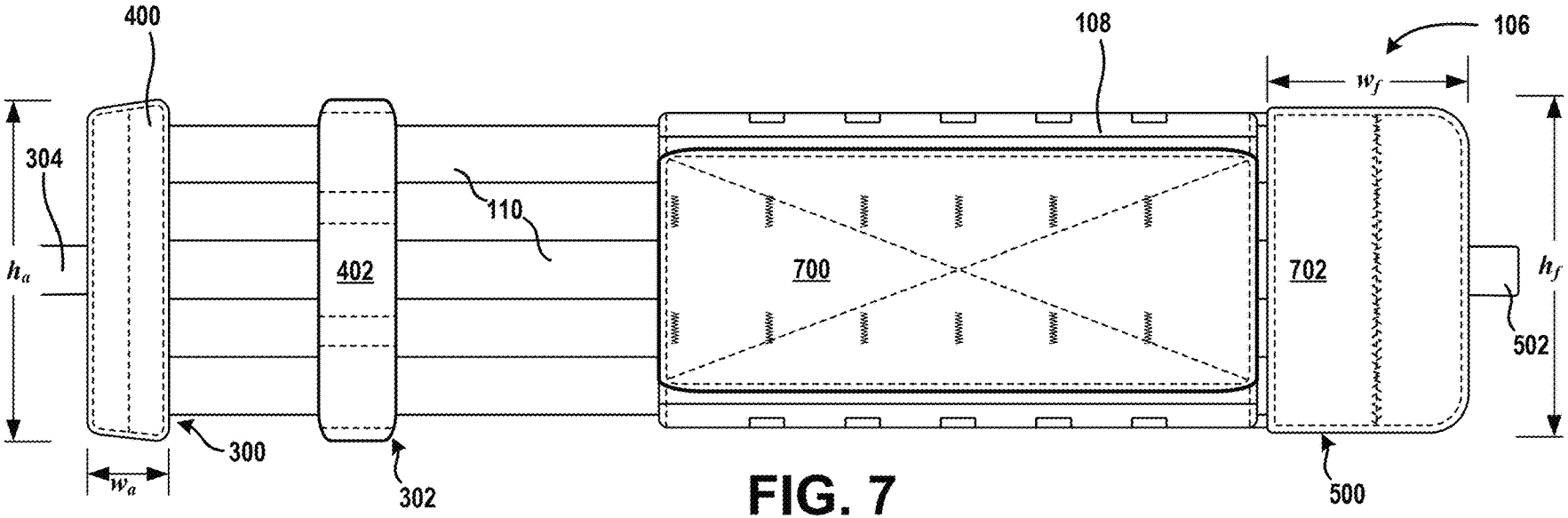
FIG. 7 is a line drawing illustrating an example configurable cummerbund for a tactical vest as viewed from a second side sometimes referred to herein as the rear side that faces toward a wearer, according to an illustrative embodiment of the concepts and technologies disclosed herein.

Turning now to FIG. 7, additional aspects of the configurable cummerbund 106 will be described in detail. In particular, FIG. 5 illustrates an inner surface (e.g., a surface of the configurable cummerbund 106 that faces toward the body of the wearer) according to an illustrative embodiment. It can be appreciated that the size, configuration, shape, and relative dimensions of the components of the configurable cummerbund 106 shown in FIG. 7 are illustrative. As such, the illustrated embodiment is illustrative and the specific embodiment shown in FIG. 7 should not be construed as being limiting in any way.

As shown in FIG. 7, the side panel 108 can include a side panel inner attachment surface 700. In some embodiments, the side panel inner attachment surface 700 can include a loop material, a hook material, or other attachment material. In the illustrated embodiment, the side panel inner attachment surface 700 can include a loop material that can be configured to engage a hook material on one or more side pouches or accessories. Because other attachment structures and/or mechanisms can be included on the inner or outer surfaces of the side panel 108, it should be understood that this example embodiment is illustrative, and therefore should not be construed as being limiting in any way.

As shown in FIG. 7, the cummerbund front tip anchor 500 can also include a cummerbund front tip anchor inner attachment surface 702. In various embodiments, as explained above with reference to FIGS. 5-6, the cummerbund front tip anchor inner attachment surface 702 can include a loop material that can engage a hook material of the front cummerbund attachment area attachment surface 600, in some embodiments. Because other attachment structures and/or mechanisms can be used in association with various embodiments of the concepts and technologies disclosed herein, it should be understood that these example embodiments are illustrative, and therefore should not be construed as being limiting in any way.

As shown in FIG. 7, the cummerbund front tip anchor 500 illustrated and described herein can have a cummerbund front tip anchor width $w_f$ and a cummerbund front tip anchor height $h_f$. Although not visible in FIG. 7, it can be appreciated that the cummerbund front tip anchor 500 also can have a cummerbund front tip anchor thickness. It can be appreciated the any relative dimensions between these measurements in FIG. 7 are illustrative and should not be construed as being limiting in any way. More particularly, it can be appreciated that the size, configuration, shape, and relative dimensions of the cummerbund front tip anchor 500 of the configurable cummerbund 106 as depicted in FIG. 7 are illustrative and should not be construed as being limiting in any way.

Similarly, the cummerbund rear tip anchor 300 illustrated and described herein can have a cummerbund rear tip anchor width $w_a$ and a cummerbund rear tip anchor height ha. Although not visible in FIG. 7, it can be appreciated that the cummerbund rear tip anchor 300 also can have a cummerbund rear tip anchor thickness. It can be appreciated the any relative dimensions between these measurements in FIG. 7 are illustrative and should not be construed as being limiting in any way. More particularly, it can be appreciated that the size, configuration, shape, and relative dimensions of the cummerbund rear tip anchor 300 of the configurable cummerbund 106 as depicted in FIG. 7 are illustrative and should not be construed as being limiting in any way.

Figure 8A:
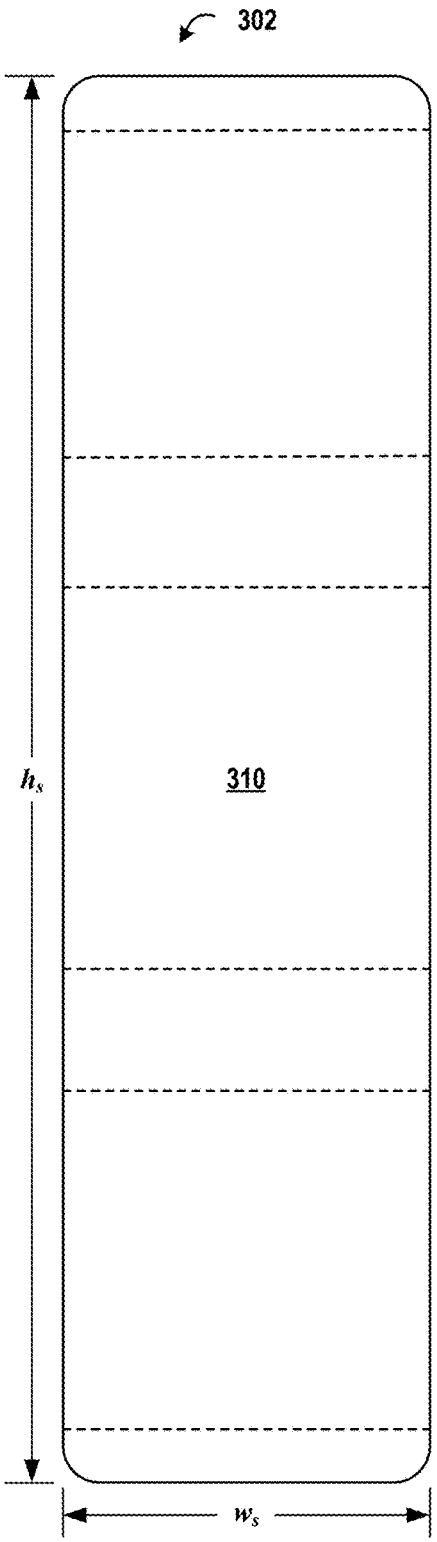
FIGS. 8A-8B are line drawings illustrating an example embodiment of a cummerbund web slider for use with a configurable cummerbund, according to an example embodiment of the concepts and technologies disclosed herein.
Figure 8B:
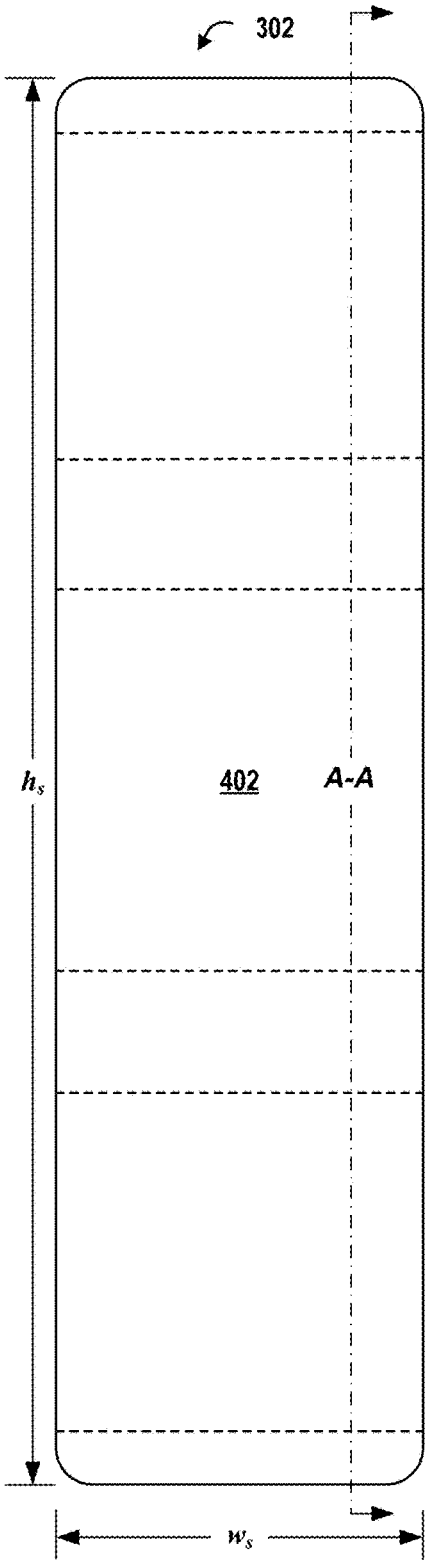

Referring now to FIGS. 8A-8B, additional aspects of the configurable cummerbund 106 will be described in detail. In particular, FIG. 8A illustrates an outer surface of the cummerbund web slider 302 (e.g., a surface of the cummerbund web slider 302 that faces toward the body of the wearer) according to an illustrative embodiment. Thus, in FIG. 8A, the cummerbund web slider outer attachment surface 310 is visible, as are dotted lines corresponding to stitching that can be used to define one or more cummerbund web passageways, which are not visible in FIGS. 8A-8B, but are illustrated and described herein. FIG. 8B illustrates an inner surface of the cummerbund web slider 302 (e.g., a surface of the cummerbund web slider 302 that faces away the body of the wearer) according to an illustrative embodiment. In FIG. 8B, the cummerbund web slider inner attachment surface 402 is visible, as are dotted lines corresponding to stitching that can be used to define one or more cummerbund web passageways. As mentioned above, the cummerbund web passageways are not visible in FIGS. 8A-8B, but are illustrated and described herein. As shown in FIGS. 8A-8B, the cummerbund web slider 302 can have a cummerbund slider width $w_s$ and a cummerbund slider height $h_s$. It can be appreciated the any relative dimensions between these measurements in FIG. 8A-8B are illustrative and should not be construed as being limiting in any way. More particularly, it can be appreciated that the size, configuration, shape, and relative dimensions of the cummerbund web slider 302 of the configurable cummerbund 106 as depicted in FIGS. 8A-8B are illustrative and should not be construed as being limiting in any way.

Figure 9:
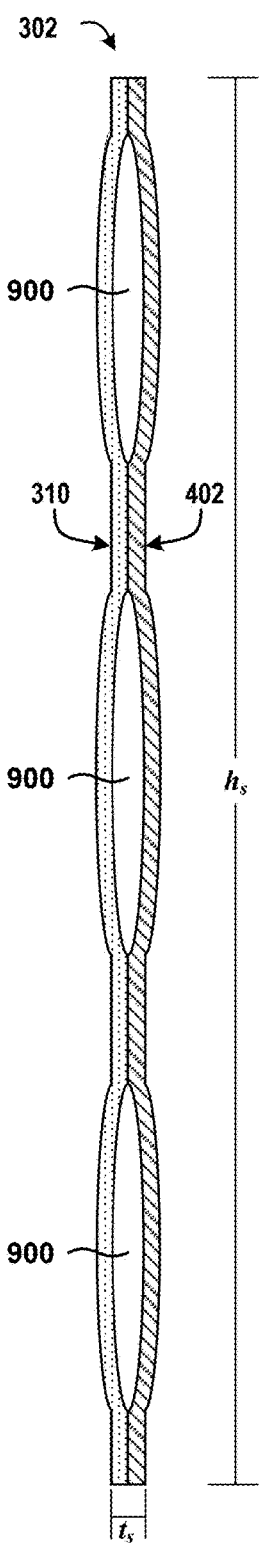
FIG. 9 is a line drawing illustrating a cross-section view of the cummerbund web slider for use with a configurable cummerbund, according to an example embodiment of the concepts and technologies disclosed herein.

Referring now to FIG. 9, additional aspects of the configurable cummerbund 106 will be described in detail. FIG. 9 is a line drawing that illustrates a cross-section view of the cummerbund web slider 302 of the configurable cummerbund 106, for example as viewed along a view line A-A as shown in FIG. 8B. It should be understood that this example embodiment is illustrative, and therefore should not be construed as being limiting in any way. As shown in FIG. 9, the cummerbund web slider outer attachment surface 310 can be formed from a first material (e.g., a hook material)

and the cummerbund web slider inner attachment surface 402 can be formed from a second material (e.g., a loop material). Because other attachment structures and/or mechanisms can be used in association with various embodiments of the concepts and technologies disclosed herein, it should be understood that these example embodiments are illustrative, and therefore should not be construed as being limiting in any way.

Figure 10:
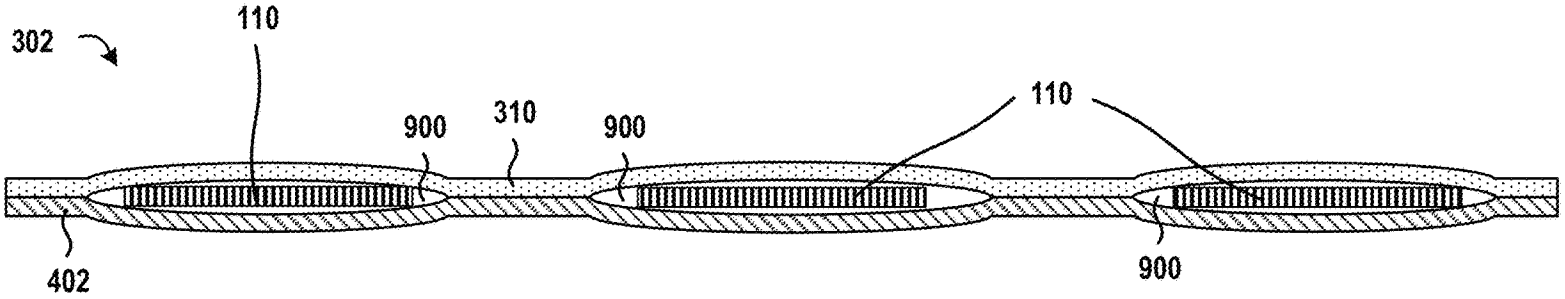
FIG. 10 is a line drawing illustrating a cross-section view of the cummerbund web slider for use with a configurable cummerbund and cummerbund webs located therein, according to an example embodiment of the concepts and technologies disclosed herein.

As can be seen in FIG. 9, the cummerbund web slider outer attachment surface 310 and the cummerbund web slider inner attachment surface 402 can be connected to one another in a manner that can create one or more cummerbund web slider web channels 900. The cummerbund webs 110 can be passed through the cummerbund web slider web channels 900, and these and other structures can enable configuration of the configurable cummerbund 106. As shown in FIG. 9, the cummerbund web slider 302 can have a cummerbund slider thickness $t_s$. In FIG. 9, the cummerbund slider thickness $t_s$ is illustrated as omitting the thickness of the cummerbund web slider web channels 900, but this is not necessarily the case, as the cummerbund web slider web channels 900 can be included in the a cummerbund slider thickness $t_s$ in some cases. As such, it can be appreciated that the size, configuration, shape, and relative dimensions of the cummerbund web slider 302 of the configurable cummerbund 106 as depicted in FIG. 9 are illustrative and should not be construed as being limiting in any way. FIG. 10 illustrates the cummerbund webs 110 passing through the cummerbund web slider web channels 900. It should be understood that this example embodiment is illustrative, and therefore should not be construed as being limiting in any way.

Figure 11:
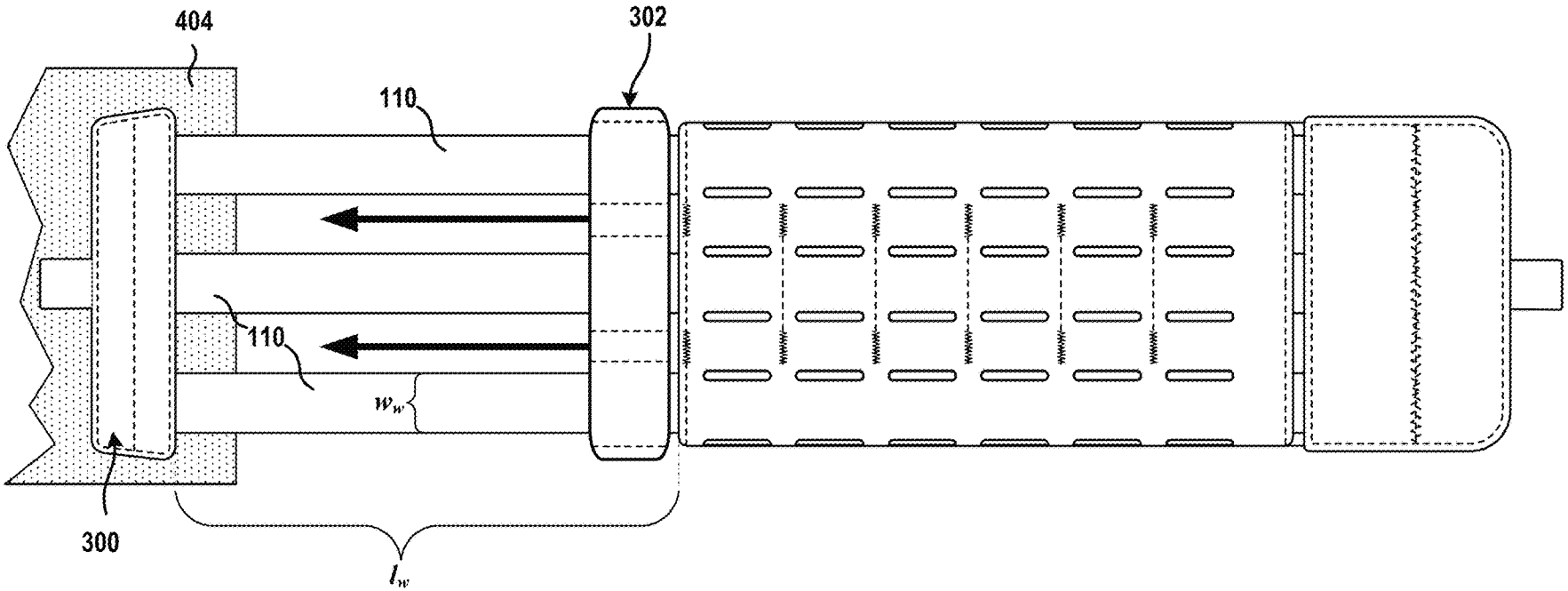
FIG. 11 is a line drawing illustrating an example configuration of configurable cummerbunds for a tactical vest, according to an illustrative embodiment of the concepts and technologies disclosed herein.

Now that the various structures of the configurable cummerbund 106 have been disclosed, additional features of the configurable cummerbund 106 are disclosed in the other FIGURES. Turning to FIG. 11, it can be appreciated that the cummerbund webs 110 can have a web width ww, which can be measured in various embodiments (including the illustrated embodiment) from a top to a bottom of cummerbund webs 110. The web width ww of the cummerbund webs 110 can be varied according to various needs or desires. In some embodiments of the concepts and technologies disclosed herein, multiple cummerbund webs 110 of a configurable cummerbund 106 can have the same web width Ww and/or different widths ww. As such, it should be understood that the illustrated embodiment is illustrative, and therefore should not be construed as being limiting in any way.

As explained herein, the cummerbund webs 110 also can have a length l. In some embodiments, the length l can refer to a portion of the cummerbund web(s) 110 that is located between the side panel 108 and the cummerbund rear tip anchor 300. It should be understood that this example embodiment is illustrative, and therefore should not be construed as being limiting in any way. As shown in FIG. 11, the cummerbund web slider 302 can be configured to selectively slide along the web length $l_w$ of the cummerbund webs 110, thereby enabling selective shortening and/or lengthening of the configurable cummerbund by overlapping ends of the configurable cummerbund 106 as will be illustrated herein. As can be seen in FIG. 11, the cummerbund rear tip anchor 300 can be attached to the rear cummerbund attachment area attachment surface 404, and the cummerbund web slider 302 may or may not be attached to the rear cummerbund attachment area attachment surface 404. As shown in FIG. 11, the cummerbund web slider 302 is not attached to the rear cummerbund attachment area attachment surface 404. It should be understood that this example embodiment is illustrative, and therefore should not be construed as being limiting in any way.

With reference to FIG. 11, it can be appreciated that the cummerbund web slider 302 can be located at the cummerbund webs 110, but that the cummerbund web slider 302 is not attached to the cummerbund webs 110. Rather, the cummerbund webs 110 can pass through and slidingly engage the cummerbund web slider web channels 900 of the cummerbund web slider 302, thereby enabling the cummerbund web slider 302 to be selectively located (by sliding the cummerbund web slider 302 along the cummerbund webs 110) between the side panel 108 and the cummerbund rear tip anchor 300. It should be understood that this example embodiment is illustrative, and therefore should not be construed as being limiting in any way.

Turning now to FIGS. 12-15, various contemplated configurations of overlapping and/or non-overlapping configurable cummerbunds 106 are shown to illustrate various possible configurations, particularly with respect to ends of the configurable cummerbunds 106 that attach to the rear side 136 of the tactical vest 100. Because other configurations are possible and are contemplated, it should be understood that these example embodiments are illustrative, and therefore should not be construed as being limiting in any way.

Figure 12:
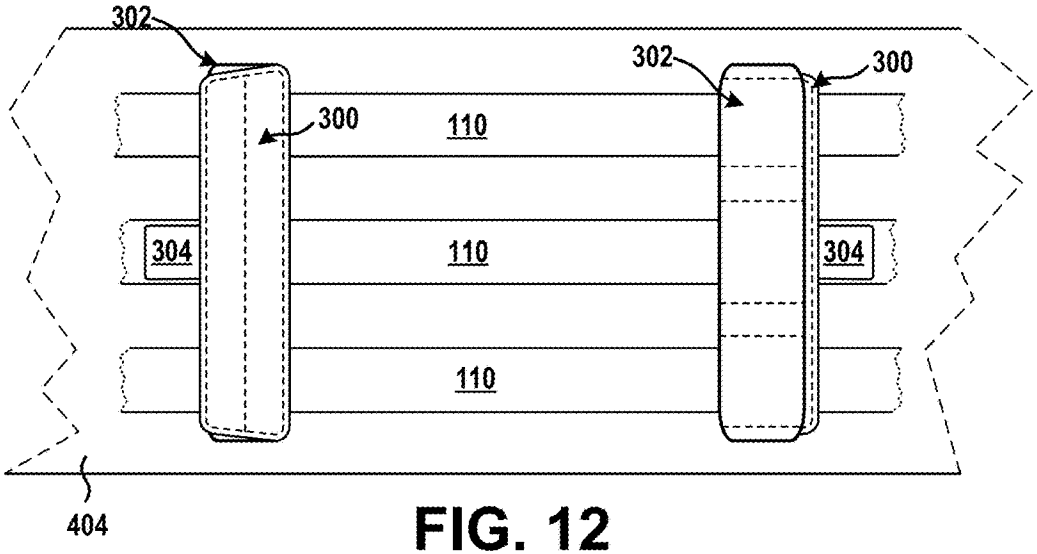
FIGS. 12-16 are line drawings illustrating example configurations of configurable cummerbunds for a tactical vest, according to various illustrative embodiments of the concepts and technologies disclosed herein.

Turning first to FIG. 12, it can be appreciated that a configuration similar to the configuration illustrated and described above with reference to FIG. 3 is shown. In particular, FIG. 12 illustrates portions of two configurable cummerbunds 106 overlapping and attaching to one another, and one of the configurable cummerbunds 106 engaging the rear cummerbund attachment area attachment surface 404. The second configurable cummerbund 106 at least partially engages the first configurable cummerbund 106. For example, in FIG. 12, the cummerbund rear tip anchor inner attachment surface 400 and the cummerbund web slider inner attachment surface 402 of the first configurable cummerbund 106 can engage the rear cummerbund attachment area attachment surface 404 of the tactical vest 100; the cummerbund rear tip anchor inner attachment surface 400 of the second configurable cummerbund 106 can engage the cummerbund rear tip anchor outer attachment surface 312 of the first configurable cummerbund 106; and the cummerbund web slider inner attachment surface 402 of the second configurable cummerbund 106 can engage the cummerbund web slider outer attachment surface 310 of the first configurable cummerbund 106. Although not visible in FIG. 12, it can be appreciated that the rear cummerbund attachment area cover attachment surface 308 can also be configured to engage the cummerbund web slider outer attachment surface 310 and cummerbund rear tip anchor outer attachment surface 312 of the second configurable cummerbund 106. It should be understood that this example embodiment is illustrative, and therefore should not be construed as being limiting in any way.

Figure 13:
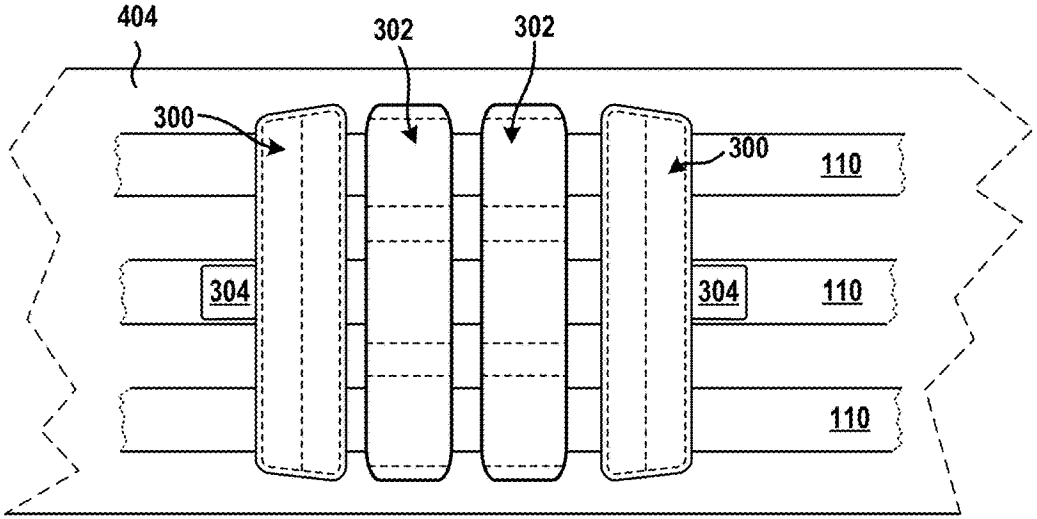

Turning now to FIG. 13, another configuration of the configurable cummerbunds 106 is illustrated. In particular, FIG. 13 illustrates portions of two configurable cummerbunds 106 partially overlapping and attaching and engaging the rear cummerbund attachment area attachment surface 404. In particular, in FIG. 13 the cummerbund rear tip anchor inner attachment surface 400 and the cummerbund web slider inner attachment surface 402 of a first configurable cummerbund 106 can engage the rear cummerbund attachment area attachment surface 404 of the tactical vest 100 and the cummerbund rear tip anchor inner attachment surface 400 and the cummerbund web slider inner attachment surface 402 of a second configurable cummerbund 106 can partially overlap the cummerbund webs 110 of the first configurable cummerbund 106, but also can at least partially engage (e.g., wherein not touching the cummerbund webs 110 of the first configurable cummerbund 106) the rear cummerbund attachment area attachment surface 404. In this configuration, both the first configurable cummerbund 106 and the second configurable cummerbund 106 can be attached to the rear cummerbund attachment area attachment surface 404. Also, though not visible in FIG. 13, the rear cummerbund attachment area cover attachment surface 308 can also be configured to engage both cummerbund web slider outer attachment surfaces 310 and cummerbund rear tip anchor outer attachment surface 312 of the first configurable cummerbund 106 and the second configurable cummerbund 106. It should be understood that this example embodiment is illustrative, and therefore should not be construed as being limiting in any way.

Figure 14:
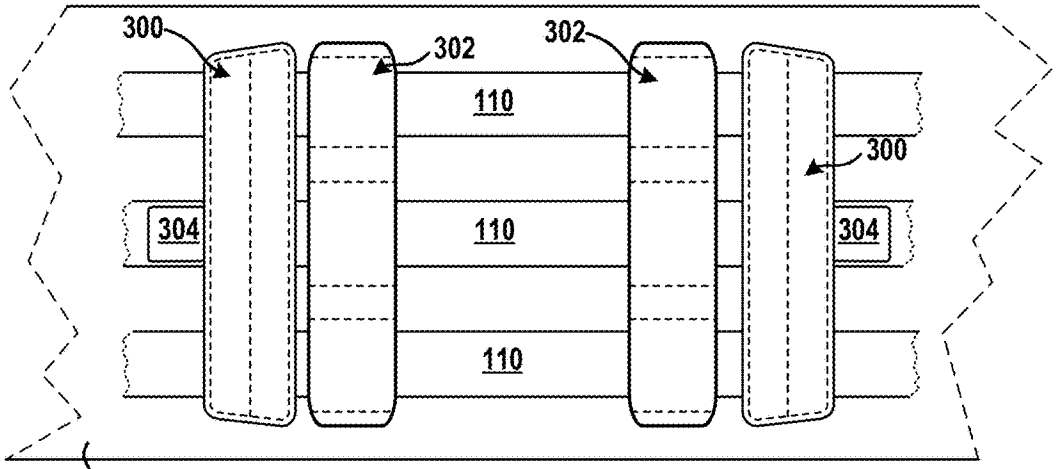
Figure 15:
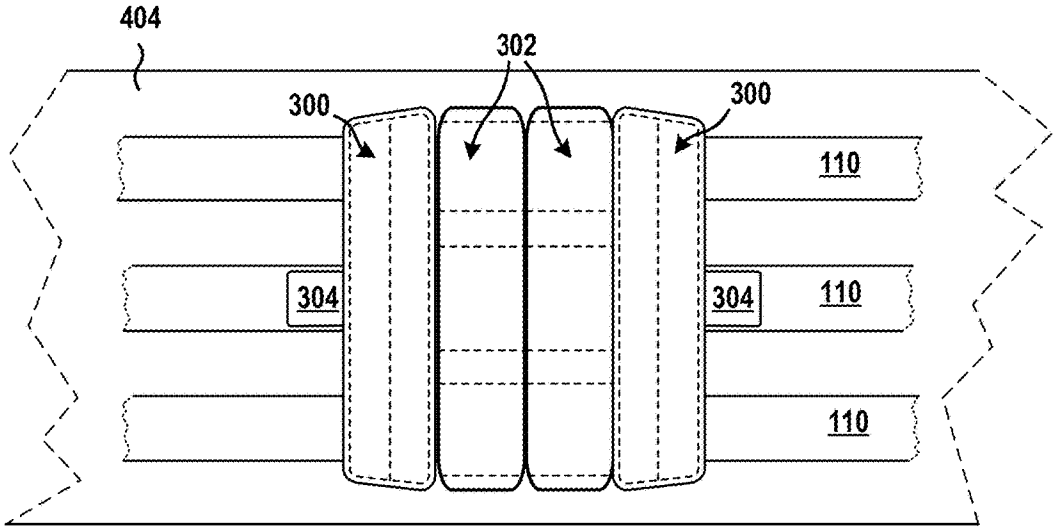

Turning now to FIGS. 14-15, alternative configurations of the configurable cummerbunds 106 are shown. In particular, FIGS. 14-15 illustrate portions of two configurable cummerbunds 106 partially overlapping and attaching and engaging the rear cummerbund attachment area attachment surface 404 in a manner that can be similar to FIG. 13, but where the location of the cummerbund rear tip anchors 300 and the cummerbund web sliders 302 have been changed to lengthen or shorten the effective length of the configurable cummerbunds 106 (e.g., with additional overlapping cummerbund webs 110 of the two configurable cummerbunds 106, the effective length of the configurable cummerbunds 106 is shortened and a size of the tactical vest 100 is effectively reduced, while reducing overlapping cummerbund webs 110 of the two configurable cummerbunds, can result in the effective length of the configurable cummerbunds 106 being increased and a size of the tactical vest 100 being similarly increased). Although not visible in FIGS. 14-15, the rear cummerbund attachment area cover attachment surface 308 can be configured to engage both cummerbund web slider outer attachment surfaces 310 and cummerbund rear tip anchor outer attachment surface 312 of the first configurable cummerbund 106 and the second configurable cummerbund 106. It should be understood that this example embodiment is illustrative, and therefore should not be construed as being limiting in any way.

Figure 16:
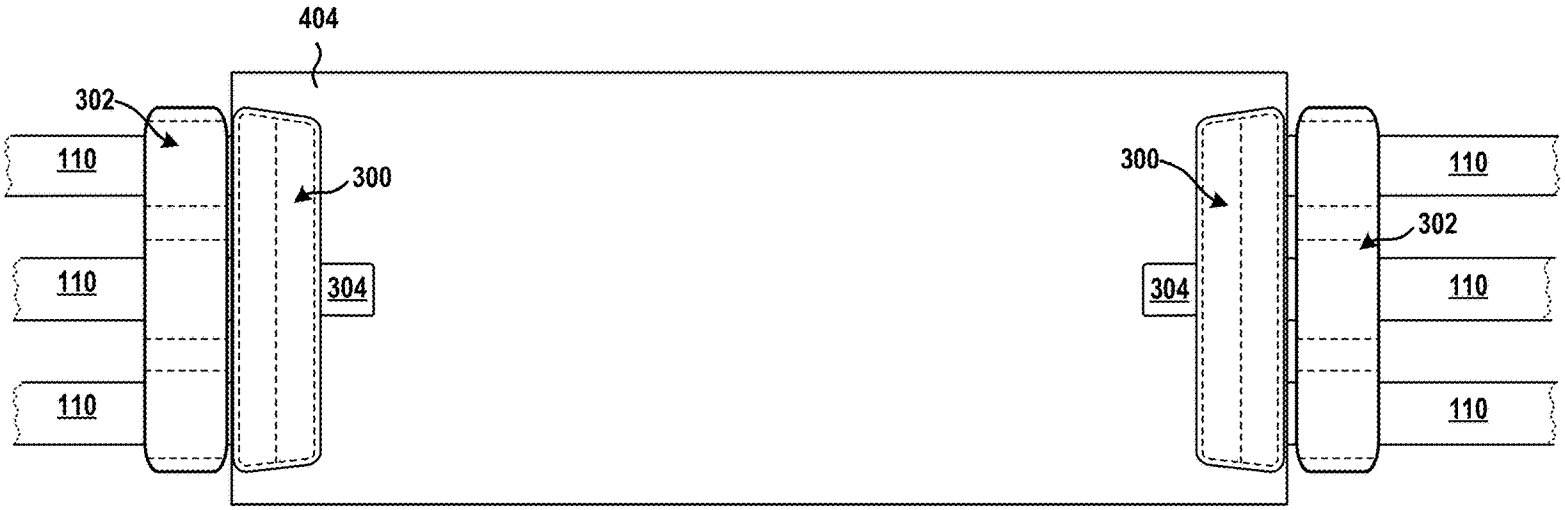

Turning now to FIG. 16, another alternative configuration of the configurable cummerbunds 106 are shown. In particular, FIG. 16 illustrates another embodiment in which only the respective cummerbund rear tip anchors 300 of the two configurable cummerbunds 106 attach to and engage the rear cummerbund attachment area attachment surface 404, while the respective cummerbund web sliders 302 are not engaging the rear cummerbund attachment area attachment surface 404. Thus, among the illustrated embodiments shown herein, the effective length of the configurable cummerbunds 106 and/or the resulting effective size of the tactical vest 100 would be maximized with the embodiment shown in FIG. 16. It should be understood that this example embodiment is illustrative, and therefore should not be construed as being limiting in any way. Although not visible in FIG. 16, the rear cummerbund attachment area cover attachment surface 308 can be configured to engage both cummerbund rear tip anchor outer attachment surface 312 of the first configurable cummerbund 106 and the second configurable cummerbund 106. It should be understood that this example embodiment is illustrative, and therefore should not be construed as being limiting in any way.

Figure 17:
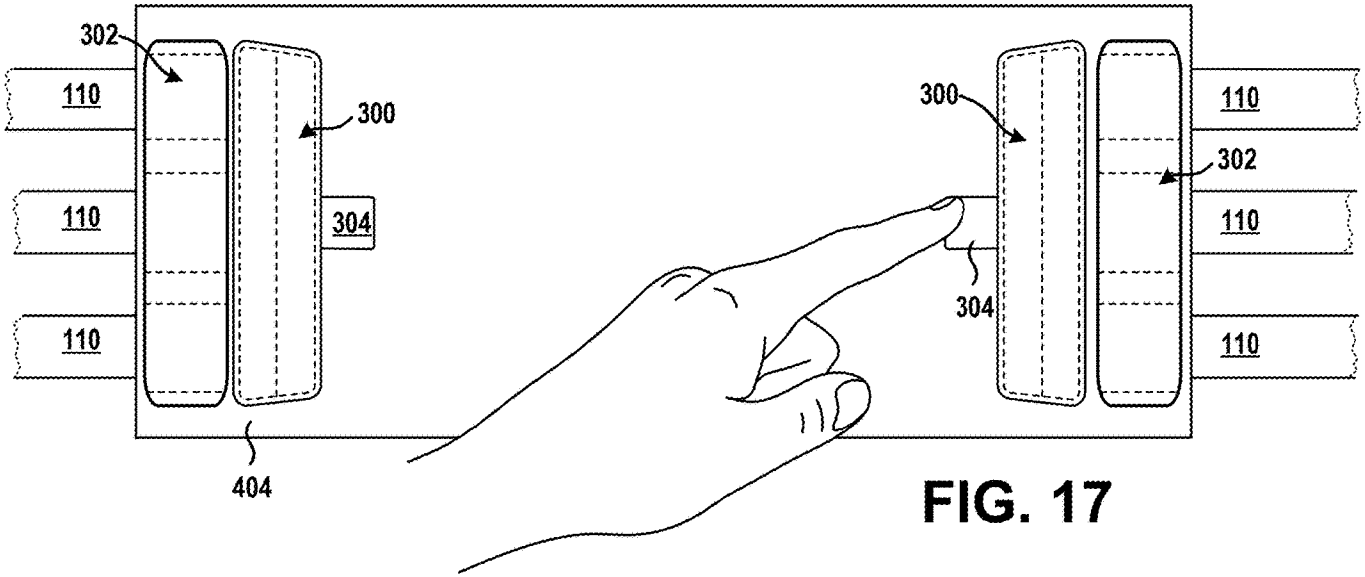
FIGS. 17-19 are line drawings illustrating an example of configuring the configurable cummerbunds for a tactical vest, according to various illustrative embodiments of the concepts and technologies disclosed herein.
Figure 18:
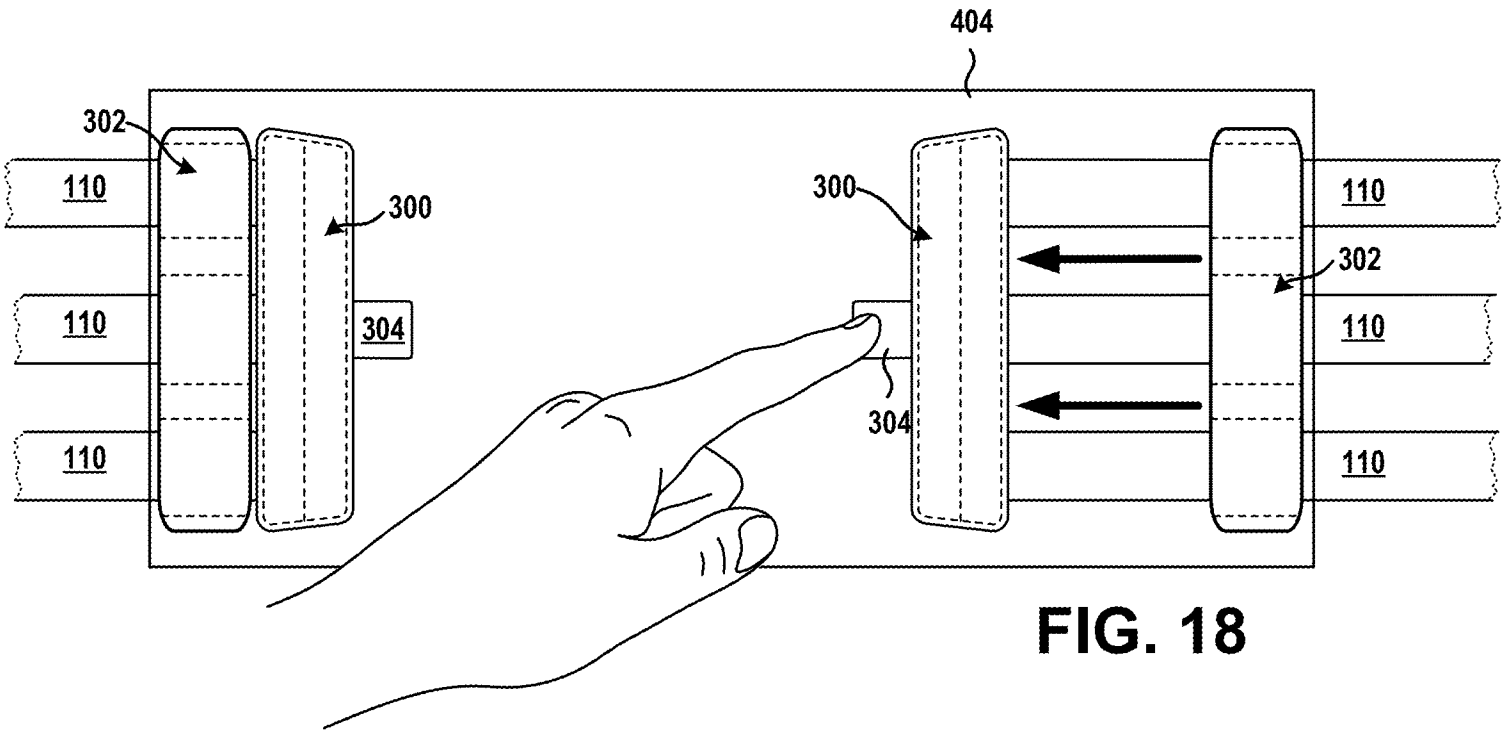
Figure 19:
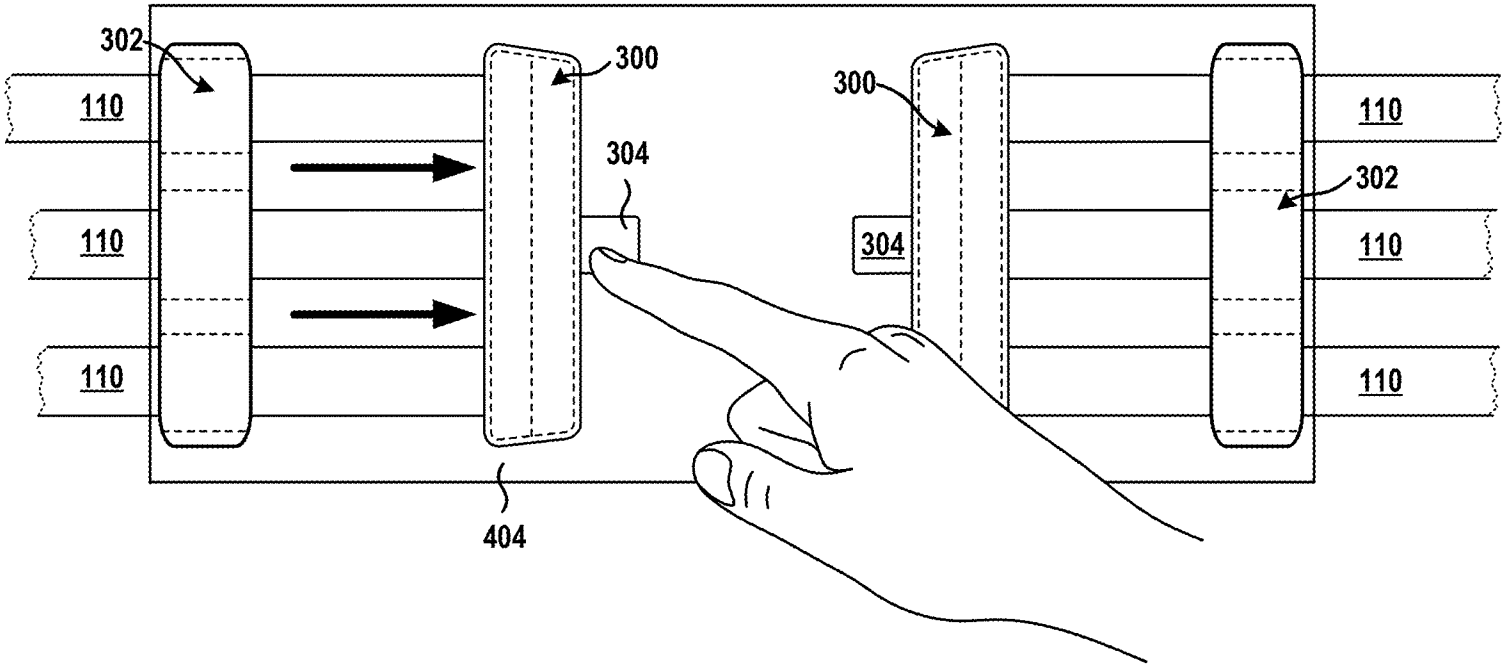

Turning now to FIGS. 17-19, another feature of the configurable cummerbunds is illustrated. In particular, as shown in FIG. 17, the configurable cummerbunds 106 can be located so that the cummerbund rear tip anchor inner attachment surface 400 and the cummerbund web slider inner attachment surfaces 402 of both the first configurable cummerbund 106 and the second configurable cummerbund 106 can engage the rear cummerbund attachment area attachment surface 404 of the tactical vest 100. Although not visible in FIG. 17, the rear cummerbund attachment area cover attachment surface 308 can also be configured to engage both cummerbund web slider outer attachment surfaces 310 and cummerbund rear tip anchor outer attachment surfaces 312 of the first configurable cummerbund 106 and the second configurable cummerbund 106. It should be understood that this example embodiment is illustrative, and therefore should not be construed as being limiting in any way.

As shown in FIGS. 18-19, by disengaging (from the rear cummerbund attachment area attachment surface 404) the cummerbund rear tip anchor inner attachment surface 400 of a configurable cummerbund 106 without disengaging (from the rear cummerbund attachment area attachment surface 404) the cummerbund web slider inner attachment surface 402 of the same configurable cummerbund 106, a user or other entity can pull the cummerbund webs 110 of the configurable cummerbund 106 through the cummerbund web slider web channels 900 (not visible in FIGS. 18-19) of the cummerbund web slider 302. Thus, by successively configuring the first configurable cummerbund 106 and the second configurable cummerbund 106 as shown in FIGS. 18-19, the effective length of the configurable cummerbunds 106 and the effective size of the tactical vest 100 can be reduced. It should be understood that this example embodiment is illustrative, and therefore should not be construed as being limiting in any way.

Various embodiments of the configurable cummerbund 106 illustrated and described herein can have various features and/or provide various benefits that may not be immediately clear from the above description. In particular, various embodiments of the configurable cummerbund 106 can provide a wide range of adjustment (e.g., in terms of length and the like) without requiring snaps, quick releases, ties, or the like. Rather, as illustrated and described herein, the configurable cummerbund 106 can use hook and loop materials on both ends of the configurable cummerbund 106 to attach to the tactical vest 100 without requiring snaps, buckles, ties, or the like. It should be understood that this example embodiment is illustrative, and therefore should not be construed as being limiting in any way.

Additionally and/or alternatively, embodiments of the configurable cummerbund 106 illustrated and described herein can be configured to enable adjustment of the configurable cummerbund 106 at the back of the tactical vest 100, which can assist in keeping the length adjustment and/or configuration of the configurable cummerbund 106 protected (e.g., by covering the cummerbund rear tip anchor(s) 300 of one or more configurable cummerbund(s) 106 in their selected location on the rear cummerbund attachment area 200 using the rear cummerbund attachment area cover 202). Thus, it can be appreciated that the specific placement of one or more cummerbund rear tip anchor(s) 300 of one or more configurable cummerbund(s) 106 on/at the rear cummerbund attachment area 200 can be less susceptible to accidental or deliberate movements by users or others by locating these elements at the back of the tactical vest 100 (relative to placing those elements at the front of the tactical vest 100). It should be understood that this example embodiment is illustrative, and therefore should not be construed as being limiting in any way.

Similarly, if one or more cummerbund web slider(s) 302 configuration of one or more configurable cummerbund(s) 106 are attached to the rear cummerbund attachment area 200 (as attaching the cummerbund web slider(s) 302 to the rear cummerbund attachment area 200 is optional as illustrated and described herein), it can be appreciated that the selected location, placement, and/or configuration of the cummerbund web slider(s) 302 (relative to the rear cummerbund attachment area 200) can be protected (e.g., by covering one or more of the cummerbund web slider(s) 302 of one or more configurable cummerbund(s) 106 in their selected location, configuration, and/or position on or at the rear cummerbund attachment area 200 using the rear cummerbund attachment area cover 202). Thus, it can be appreciated that the specific placement of one or more cummerbund web slider(s) 302 of one or more configurable cummerbund(s) 106 on/at the rear cummerbund attachment area 200 can be less susceptible to accidental or deliberate movements by users or others by locating these elements at the back of the tactical vest 100 (relative to placing those elements at the front of the tactical vest 100). It should be understood that this example embodiment is illustrative, and therefore should not be construed as being limiting in any way.

Similarly, because some wearers and/or users of tactical vests 100 may disconnect one end of the configurable cummerbund 106 from the tactical vest 100 to put on or take off the tactical vest 100, it can be appreciated that placing the elements used to adjust the length of the configurable cummerbund 106 (e.g., the cummerbund rear tip anchor(s) 300 and the cummerbund web slider(s) 302) at the rear of the tactical vest 100 and placing the cummerbund front tip anchor(s) 500 at the front of the tactical vest 100 can enable a user or wearer to easily open one side of the configurable cummerbund 106 without affecting the adjustment of the configurable cummerbund 106 (e.g., by releasing the cummerbund front tip anchor 500 from the front cummerbund attachment area 112). It should be understood that this example embodiment is illustrative, and therefore should not be construed as being limiting in any way.

Although not specifically mentioned above, it can be appreciated that the cummerbund web slider 302 of the configurable cummerbund 106 can provide additional benefits not specifically mentioned above. In particular, it can be appreciated that the configuration of the configurable cummerbund 106 and the wide range of adjustments and/or configurations possible for the configurable cummerbund 106 can result by including, in some embodiments, cummerbund webs 110 that may have a length that longer than some other cummerbunds used in association with plate carriers and/or other tactical vests. Some embodiments of the cummerbund web slider 302 can enable the cummerbund webs 110 to be maintained in their relative positions relative to one another (e.g., without the cummerbund webs 110 overlapping and/or being tangled together, or the like) providing support surfaces for the cummerbund webs 110 between the cummerbund rear tip anchor 300 and the side panel 108. This can enable a user or other wearer of a tactical vest 100 including the configurable cummerbund 106 to lengthen the configurable cummerbund 106 considerably (e.g., by supporting the cummerbund webs 110 and preventing overlapping and/or tangling, the cummerbund web slider 302 can enable the use of long cummerbund webs 110, which can allow longer cummerbund webs 110 and therefore a wider range of adjustment in terms of the cummerbund length $l_c$ of the configurable cummerbund 106). It should be understood that this example embodiment is illustrative, and therefore should not be construed as being limiting in any way.

As mentioned herein, the illustrated tactical vest 100 is purely illustrative and should not be construed as being limiting in any way. In particular, embodiments of the configurable cummerbund 106 and/or some elements of the configurable cummerbund 106 can be used in association with various types of vests without departing from the scope of this disclosure. As such, it should be understood that the illustrated embodiments of the tactical vest 100 and the specific configuration of the configurable cummerbund 106 are illustrative and should not be construed as being limiting in any way.

Based on the foregoing, it can be appreciated that a configurable cummerbund for a tactical vest has been disclosed herein. Although the subject matter presented herein has been described with respect to various structural features and/or methodological and transformative acts for forming the configurable cummerbund for a tactical vest and/or the various features thereof, it is to be understood that the concepts and technologies disclosed herein are not necessarily limited to the specific features or acts described herein. Rather, the specific features and acts are disclosed as example forms of implementing the concepts and technologies disclosed herein.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

The invention claimed is:

1. A configurable cummerbund for a tactical vest, the configurable cummerbund comprising:

a first end;

a second end;

a cummerbund front tip anchor located at the first end, the cummerbund front tip anchor comprising a cummerbund front tip anchor outer attachment surface located at a first side of the cummerbund front tip anchor and a cummerbund front tip anchor inner attachment surface located at a second side of the cummerbund front tip anchor;

a plurality of webs attached to the cummerbund front tip anchor and extending along a length from the first end to the second end;

a side panel attached to the plurality of webs, wherein the side panel comprises a first side that is configured to face away from a wearer and a second side that is configured to face toward the wearer;

a cummerbund rear tip anchor located at the second end, the cummerbund rear tip anchor comprising a cummerbund rear tip anchor outer attachment surface located at a first side of the cummerbund rear tip anchor and a cummerbund rear tip anchor inner attachment surface located at a second side of the cummerbund rear tip anchor; and a cummerbund web slider located at the plurality of webs between the side panel and the cummerbund rear tip anchor, wherein the plurality of webs pass through and slidingly engage cummerbund web slider web channels, whereby the cummerbund web slider is configured to be selectively located between the side panel and the cummerbund rear tip anchor.

2. The configurable cummerbund of claim 1, wherein the cummerbund front tip anchor further comprises a cummerbund front tip anchor pull tab that is configured to be manipulated to disengage the cummerbund front tip anchor from an attachment surface of the tactical vest.

3. The configurable cummerbund of claim 1, wherein the cummerbund rear tip anchor inner attachment surface comprises a hook material, and wherein the cummerbund rear tip anchor outer attachment surface comprises a loop material.

4. The configurable cummerbund of claim 3, wherein the cummerbund rear tip anchor inner attachment surface comprises a further hook material that is configured to engage a further loop material of a further cummerbund web slider of a further configurable cummerbund.

5. The configurable cummerbund of claim 1, wherein the cummerbund front tip anchor inner attachment surface comprises a hook material, and wherein the cummerbund front tip anchor outer attachment surface comprises a loop material.

6. The configurable cummerbund of claim 1, wherein the cummerbund rear tip anchor is configured to overlap and engage a further cummerbund web slider of a further configurable cummerbund, and wherein the cummerbund web slider is configured to overlap and engage a further cummerbund rear tip anchor of the further configurable cummerbund.

7. The configurable cummerbund of claim 1, wherein the cummerbund rear tip anchor outer attachment surface comprises a loop material that is configured to engage a hook material of a rear cummerbund attachment area cover of the tactical vest, and wherein the cummerbund rear tip anchor outer attachment surface comprises a further loop material that is configured to engage the hook material of the rear cummerbund attachment area cover of the tactical vest.

8. The configurable cummerbund of claim 1, wherein the side panel comprises a mounting surface located at the first side, and a loop material located at the second side, wherein the loop material is configured to engage a hook material of an accessory or pouch.

9. A configurable cummerbund for a tactical vest, the configurable cummerbund comprising:

a first end;

a second end;

a cummerbund front tip anchor located at the first end, the cummerbund front tip anchor comprising a cummerbund front tip anchor outer attachment surface located at a first side of the cummerbund front tip anchor and a cummerbund front tip anchor inner attachment surface located at a second side of the cummerbund front tip anchor, wherein the cummerbund front tip anchor is configured to engage a front cummerbund attachment area of the tactical vest;

three webs attached to the cummerbund front tip anchor and extending along a length from the first end to the second end;

a side panel attached to the three webs, wherein the side panel comprises a first side that is configured to face away from a wearer and a second side that is configured to face toward the wearer;

a cummerbund rear tip anchor located at the second end, the cummerbund rear tip anchor comprising a cummerbund rear tip anchor outer attachment surface located at a first side of the cummerbund rear tip anchor and a cummerbund rear tip anchor inner attachment surface located at a second side of the cummerbund rear tip anchor, wherein the cummerbund rear tip anchor is configured to engage a rear cummerbund attachment area of the tactical vest; and a cummerbund web slider located at the three webs between the side panel and the cummerbund rear tip anchor, wherein the three webs pass through and slidingly engage three corresponding cummerbund web slider web channels, whereby the cummerbund web slider is configured to be selectively located between the side panel and the cummerbund rear tip anchor.

10. The configurable cummerbund of claim 9, wherein the cummerbund rear tip anchor inner attachment surface comprises a hook material, and wherein the cummerbund rear tip anchor outer attachment surface comprises a loop material.

11. The configurable cummerbund of claim 10, wherein the cummerbund rear tip anchor inner attachment surface comprises a further hook material that is configured to engage a further loop material of a further cummerbund web slider of a further configurable cummerbund.

12. The configurable cummerbund of claim 9, wherein the cummerbund front tip anchor inner attachment surface comprises a hook material, and wherein the cummerbund front tip anchor outer attachment surface comprises a loop material.

13. The configurable cummerbund of claim 9, wherein the cummerbund rear tip anchor is configured to overlap and engage a further cummerbund web slider of a further configurable cummerbund, and wherein the cummerbund web slider is configured to overlap and engage a further cummerbund rear tip anchor of the further configurable cummerbund.

14. The configurable cummerbund of claim 9, wherein the cummerbund rear tip anchor outer attachment surface comprises a loop material that is configured to engage a hook material of a rear cummerbund attachment area cover of the tactical vest, and wherein the cummerbund rear tip anchor outer attachment surface comprises a further loop material that is configured to engage the hook material of the rear cummerbund attachment area cover of the tactical vest.

15. The configurable cummerbund of claim 9, wherein the side panel comprises a mounting surface located at the first side, and a loop material located at the second side, wherein the loop material is configured to engage a hook material of an accessory or pouch.

16. A configurable cummerbund for a tactical vest, the configurable cummerbund comprising:

a first end comprising a cummerbund front tip anchor pull tab;

a second end a cummerbund rear tip anchor pull tab;

a cummerbund front tip anchor located at the second end, the cummerbund front tip anchor comprising a cummerbund front tip anchor outer attachment surface located at a first side of the cummerbund front tip anchor and a cummerbund front tip anchor inner attachment surface located at a second side of the cummerbund front tip anchor, wherein the cummerbund front tip anchor is configured to engage a front cummerbund attachment area of the tactical vest;

three webs attached to the cummerbund front tip anchor and extending along a length from the first end to the second end;

a side panel attached to the three webs, wherein the side panel comprises a first side that is configured to face away from a wearer and a second side that is configured to face toward the wearer;

a cummerbund rear tip anchor located at the first end, the cummerbund rear tip anchor comprising a cummerbund rear tip anchor outer attachment surface located at a first side of the cummerbund rear tip anchor and a cummerbund rear tip anchor inner attachment surface located at a second side of the cummerbund rear tip anchor, wherein the cummerbund rear tip anchor is configured to engage a rear cummerbund attachment area of the tactical vest; and a cummerbund web slider located at the three webs between the side panel and the cummerbund rear tip anchor, wherein the three webs pass through and slidingly engage three corresponding cummerbund web slider web channels, whereby the cummerbund web slider is configured to be selectively located between the side panel and the cummerbund rear tip anchor.

17. The configurable cummerbund of claim 16, wherein the cummerbund rear tip anchor inner attachment surface comprises a hook material, wherein the cummerbund rear tip anchor outer attachment surface comprises a loop material, wherein the cummerbund rear tip anchor inner attachment surface comprises a further hook material that is configured to engage a further loop material of a further cummerbund web slider of a further configurable cummerbund.

18. The configurable cummerbund of claim 16, wherein the cummerbund front tip anchor inner attachment surface comprises a hook material, and wherein the cummerbund front tip anchor outer attachment surface comprises a loop material.

19. The configurable cummerbund of claim 16, wherein the cummerbund rear tip anchor is configured to overlap and engage a further cummerbund web slider of a further configurable cummerbund, and wherein the cummerbund web slider is configured to overlap and engage a further cummerbund rear tip anchor of the further configurable cummerbund.

20. The configurable cummerbund of claim 16, wherein the cummerbund rear tip anchor outer attachment surface comprises a loop material that is configured to engage a hook material of a rear cummerbund attachment area cover of the tactical vest, and wherein the cummerbund rear tip anchor outer attachment surface comprises a further loop material that is configured to engage the hook material of the rear cummerbund attachment area cover of the tactical vest.

* * * * *